US009500053B2

(12) United States Patent
Leuchtenberg

(10) Patent No.: US 9,500,053 B2
(45) Date of Patent: Nov. 22, 2016

(54) DRILLING SYSTEM AND METHOD OF OPERATING A DRILLING SYSTEM

(71) Applicant: Managed Pressure Operations Pte. Ltd., Singapore (SG)

(72) Inventor: Christian Leuchtenberg, Singapore (SG)

(73) Assignee: MANAGED PRESSURE OPERATIONS PTE. LTD., Singapore (SG)

( * ) Notice: Subject to any disclaimer, the term of this patent is extended or adjusted under 35 U.S.C. 154(b) by 0 days.

(21) Appl. No.: 14/572,448

(22) Filed: Dec. 16, 2014

(65) Prior Publication Data

US 2015/0167415 A1 Jun. 18, 2015

(30) Foreign Application Priority Data

Dec. 17, 2013 (GB) ..... 1322327.6

(51) Int. Cl.

| | |
|---|---|
| ***E21B 7/12*** | (2006.01) |
| ***E21B 21/08*** | (2006.01) |
| ***E21B 21/10*** | (2006.01) |
| ***E21B 33/038*** | (2006.01) |
| ***E21B 17/01*** | (2006.01) |
| ***E21B 21/06*** | (2006.01) |
| *E21B 21/00* | (2006.01) |

(52) U.S. Cl.

CPC ..... *E21B 21/106* (2013.01); *E21B 17/01* (2013.01); *E21B 21/067* (2013.01); *E21B 21/08* (2013.01); *E21B 33/038* (2013.01); *E21B 2021/005* (2013.01); *Y10T 137/0396* (2015.04); *Y10T 137/2934* (2015.04)

(58) Field of Classification Search

CPC ..... E21B 7/12; E21B 21/067; E21B 21/08; E21B 21/106; E21B 21/001

USPC ..... 175/5, 40, 48; 166/357, 358

See application file for complete search history.

(56) References Cited

U.S. PATENT DOCUMENTS

| | | | |
|---|---|---|---|
| 3,241,295 | A | 3/1966 | Griffin, III et al. |
| 3,313,345 | A | 4/1967 | Fischer |
| 3,362,136 | A | 1/1968 | Burnham, Sr. et al. |
| 3,363,404 | A | 1/1968 | Griffin, III et al. |
| 3,500,943 | A | 3/1970 | Bingman, Jr. |
| 3,675,713 | A | 7/1972 | Watkins |
| 3,695,633 | A | 10/1972 | Hanes |
| 3,895,927 | A | 7/1975 | Bournham, Sr. |
| 3,910,110 | A | 10/1975 | Jefferies et al. |
| 3,976,148 | A | 8/1976 | Maus et al. |
| 4,010,012 | A | 3/1977 | Griffin, III et al. |
| 4,059,148 | A | 11/1977 | Blomsma |

(Continued)

FOREIGN PATENT DOCUMENTS

| | | | |
|---|---|---|---|
| CN | 1553984 | A | 12/2004 |
| CN | 1611742 | A | 5/2005 |

(Continued)

*Primary Examiner* — Matthew R Buck

(74) *Attorney, Agent, or Firm* — Norman B. Thot

(57) ABSTRACT

A drilling system including a riser, a pressure vessel, a source of pressurized gas, and a main flow line which extends from the riser to the pressure vessel, the pressure vessel having a liquid inlet port connected to the main flow line, a gas inlet port connected to the source of pressurized gas, a liquid outlet port located in a lowermost portion of the pressure vessel, and a gas outlet port located in an uppermost portion of the pressure vessel.

17 Claims, 4 Drawing Sheets

(56) References Cited

U.S. PATENT DOCUMENTS

| | | | | |
|---|---|---|---|---|
| 4,098,341 | A | 7/1978 | Lewis | |
| 4,282,939 | A | 8/1981 | Maus et al. | |
| 4,411,434 | A | 10/1983 | Lewis | |
| 4,440,239 | A | 4/1984 | Evans | |
| 4,444,250 | A | 4/1984 | Keithahn et al. | |
| 4,527,425 | A | 7/1985 | Stockton | |
| 4,566,494 | A | 1/1986 | Roche | |
| 4,610,161 | A | 9/1986 | Gehrig et al. | |
| 4,626,135 | A | 12/1986 | Roche | |
| 4,666,471 | A * | 5/1987 | Cates | E21B 21/067 175/66 |
| 4,900,445 | A * | 2/1990 | Flanigan | B01D 17/0214 210/512.1 |
| 4,971,148 | A | 11/1990 | Roche et al. | |
| 5,168,932 | A | 12/1992 | Worrall et al. | |
| 5,205,165 | A | 4/1993 | Jardine et al. | |
| 5,377,714 | A * | 1/1995 | Giannesini | E21B 43/34 137/110 |
| 5,544,672 | A * | 8/1996 | Payne | B01D 19/0063 137/1 |
| 5,662,171 | A | 9/1997 | Brugman et al. | |
| 5,928,519 | A | 7/1999 | Homan | |
| 6,004,385 | A | 12/1999 | Birmingham | |
| 6,019,174 | A * | 2/2000 | Korsgaard | B63B 22/026 166/352 |
| 6,105,689 | A | 8/2000 | McGuire et al. | |
| 6,129,152 | A | 10/2000 | Hosie et al. | |
| 6,230,809 | B1 * | 5/2001 | Korsgaard | B63B 22/026 166/352 |
| 6,234,258 | B1 * | 5/2001 | Karigan | E21B 21/062 166/267 |
| 6,263,982 | B1 | 7/2001 | Hannegan et al. | |
| 6,328,118 | B1 * | 12/2001 | Karigan | B01D 21/10 175/206 |
| 6,390,114 | B1 * | 5/2002 | Haandrikman | B01D 19/0063 137/187 |
| 6,413,297 | B1 | 7/2002 | Morgan et al. | |
| 7,140,441 | B2 * | 11/2006 | Hauge | E21B 43/36 166/267 |
| 7,147,788 | B2 * | 12/2006 | Tveiten | B01D 17/00 209/12.1 |
| 7,314,559 | B2 * | 1/2008 | Hopper | B01D 21/10 209/722 |
| 7,699,109 | B2 | 4/2010 | May et al. | |
| 7,926,560 | B2 | 4/2011 | Bailey et al. | |
| 8,973,674 | B2 | 3/2015 | Leuchtenberg | |
| 2002/0074123 | A1 | 6/2002 | Regan | |
| 2004/0007392 | A1 | 1/2004 | Judge et al. | |
| 2004/0231889 | A1 | 11/2004 | Van Riet | |
| 2005/0096848 | A1 | 5/2005 | Hou et al. | |
| 2007/0095540 | A1 | 5/2007 | Kozicz et al. | |
| 2007/0151763 | A1 | 7/2007 | Reitsma et al. | |
| 2008/0105434 | A1 | 5/2008 | Orbell et al. | |
| 2008/0210471 | A1 | 9/2008 | Bailey et al. | |
| 2009/0101351 | A1 | 4/2009 | Hannegan | |
| 2009/0139724 | A1 | 6/2009 | Gray et al. | |
| 2010/0006299 | A1 | 1/2010 | Meng | |
| 2011/0100710 | A1 * | 5/2011 | Fossli | E21B 21/001 175/7 |
| 2011/0139464 | A1 | 6/2011 | Henderson et al. | |
| 2011/0155388 | A1 | 6/2011 | Haugland | |
| 2012/0227978 | A1 * | 9/2012 | Fossli | E21B 21/001 166/363 |
| 2013/0118806 | A1 | 5/2013 | Hannegan et al. | |
| 2013/0192841 | A1 | 8/2013 | Feasey et al. | |
| 2014/0166360 | A1 * | 6/2014 | Vavik | E21B 21/001 175/5 |
| 2015/0068758 | A1 | 3/2015 | Leuchtenberg et al. | |

FOREIGN PATENT DOCUMENTS

| | | | |
|---|---|---|---|
| CN | 1643233 | A | 7/2005 |
| CN | 1836089 | A | 9/2006 |
| CN | 201330573 | Y | 10/2009 |
| CN | 201358778 | Y | 12/2009 |
| GB | 1 5843 108 | A | 3/1979 |
| GB | 2349161 | A | 10/2000 |
| GB | 2427217 | A | 12/2006 |
| GB | 2443561 | A | 5/2008 |
| GB | 2500188 | A | 9/2013 |
| WO | WO 98/28517 | A1 | 11/1997 |
| WO | WO 98/28517 | A1 | 7/1998 |
| WO | WO 99/49173 | A3 | 9/1999 |
| WO | WO 99/51852 | A1 | 10/1999 |
| WO | WO 01/36561 | A1 | 5/2001 |
| WO | WO 2007/047800 | A2 | 4/2007 |
| WO | WO 2011/104279 | A2 | 9/2011 |
| WO | WO 2011/128690 | A1 | 10/2011 |
| WO | WO 2012/127227 | A2 | 9/2012 |
| WO | WO 2012/143723 | A2 | 10/2012 |
| WO | WO 2013/000764 | A2 | 1/2013 |
| WO | WO 2013/037049 | A1 | 3/2013 |
| WO | WO 2013/135694 | A1 | 9/2013 |
| WO | WO 2013/135725 | A2 | 9/2013 |
| WO | WO 2013/153135 | A2 | 10/2013 |

* cited by examiner

DRILLING SYSTEM AND METHOD OF OPERATING A DRILLING SYSTEM

The present invention relates to a drilling system and method of operating a drilling system.

Subsea drilling typically involves rotating a drill bit from fixed or floating installation at the water surface or via a downhole motor at the remote end of a tubular drill string. It involves pumping a fluid down the inside of the tubular drill string, through the drill bit, and circulating this fluid continuously back to surface via the drilled space between the hole/drill string, referred to as the wellbore annulus, and the riser/drill string, referred to as the riser annulus. The drill string extends down through the internal bore of the riser pipe and into the wellbore, with the riser connecting the subsea BOP on the ocean floor to the floating installation at surface, thus providing a flow conduit for the drilling fluid and cuttings returns to be returned to the surface to the rig's fluid treatment system. The drill string is comprised of sections of tubular joints connected end to end, and their respective outside diameter depends on the geometry of the hole being drilled and their effect on the fluid hydraulics in the wellbore.

Drilling a wellbore on a floating installation requires a slip joint at the water's surface which utilizes an inner and outer barrel. The inner barrel is transient, extending and retracting from the outer barrel to compensate for the heaving motion of the vessel from ocean from tides and waves. Fluid leakage from the riser system is prevented between the inner and outer barrel of the slip joint by packers or seals which are hydraulically or pneumatically charged. Typically, the slip joint seal design is the weak point of the overall assembly, and affects its ability to seal at pressures beyond 500 psi, with the risk of leaking at lower pressures. The usual operational mode for all current installations is at atmospheric conditions, with the slip joint seals never seeing any significant pressure. Generally, the slip joint is located at the top of the riser and connects to the upper flex joint. The upper flex joint compensates for slight angular deflection from the movement of the floating installation, and connects to the diverter housing of the rig located directly below the rig's rotary table. Further details for a conventional slip joint's general arrangement are described in U.S. Pat. No. 4,626,135.

Conventionally, the well bore is open to atmospheric pressure and there is no surface applied pressure or other pressure existing within the system. The drill string rotates freely without any sealing elements imposed or acting on it at the surface, and flow is diverted at atmospheric pressure back to the rig's fluid treatment and storage system. This is achieved through gravity flow from the diverter flow line outlet, through the diverter flow line, and into the fluid treatment system at surface on the rig.

An alternative method of drilling is managed pressure drilling (MPD). This utilizes additional special equipment that has been developed to keep the well closed at all times, as the wellhead pressures in these cases are non-atmospheric, in contrast to the traditional art of the conventional overbalanced drilling method, described above. Thus, these operate as closed loop systems. Complexity increases when MPD techniques are applied offshore, and specifically the deeper the water the more difficult these operations become. The riser section from the seabed floor to the drilling platform becomes an extension of the wellbore—as water depth increases the riser length increases accordingly, the effects of the additional hydrostatic pressure and ECD exerted on the wellbore below become more pronounced.

Pressurized drilling techniques such as MPD produce a closed loop pressurized flow system generated by a pressure seal around the drill string at surface or deeper in the riser configuration with a pressure containment device at all times. Flow is diverted to a flow line by this device, referred to as a rotating control device (RCD), rotating control head (RCH), pressure control while drilling (PCWD), or rotating blow out preventer (RBOP). The function of the rotating pressure containment device is to allow the drill string and its tool joints to pass through with reciprocation/stripping or rotation while maintaining pressure integrity around the tubular.

With drilling activity in progress and the device closed a back pressure is can be applied on the annulus with the use of a choke manifold. The drill string is stripped or rotated through the pressure containment device which isolates the pressurized annulus from the external atmosphere while maintaining a seal around the drill string.

With these devices, the sealing element rotates with the drill string while maintaining the pressure integrity of the seal. The rotation is handled by a bearing which may be a thrust, roller, cone or ball bearings or a combination of these which requires an internal bearing and seals prone to mechanical failure from the imposed loads of drilling. These are well known in the art and are described in detail in U.S. Pat. No. 7,699,109B2, U.S. Pat. Nos. 7,926,560, and 6,129,152.

An alternative apparatus to this RCD technology, utilizing a non-rotating sealing device referred to as the Riser Drilling Device (RDD), is described in patent applications WO2012127227 and WO2011128690. This eliminates the requirement for a bearing assembly, with a single or dual seal sleeve assembly installed within a specified housing within the riser system and secured in place with hydraulically locking dogs/pistons. Rotation of the seal sleeve assembly with the drill string is prevented through the frictional forces of an adjacent annular packer assembly within the housing which applies pressure to the external surface of the seal sleeve when it is in position in the housing. The seal sleeve's mechanical structure and composite materials result in a high wear resistant low friction sealing face on the drill string. This system does not use the conventional bearing systems described in the prior art.

During drilling, the bit penetrates its way through layers of underground formations until it reaches target prospects—rocks which contain hydrocarbons at a given temperature and pressure. These hydrocarbons are contained within the pore space of the rock i.e. the void space and can contain water, oil, and gas constituents—referred to as reservoirs. Due to overburden forces from layers of rock above, these reservoir fluids are contained and trapped within the pore space at a known or unknown pressure, referred to as pore pressure. The pressure of fluid in the well bore required to break, or fracture, the rocks in these formations is called the formation fracture pressure.

Equivalent circulating density (ECD) is the increase in bottom hole pressure (BHP) expressed as an increase in pressure that occurs only when drilling fluid is being circulated. The ECD value reflects the total friction losses over the entire length of the wellbore annulus, from the point of fluid exiting the bit at the wellbore bottom to where it exits the well at the diverter flow line outlet on the floating installation. The ECD can result in a BHP during circulating/drilling that varies from slightly to significantly higher values when compared to static conditions i.e. no circulation.

If the BHP falls below the pore pressure, this could result in unplanned inflow of reservoir fluids into the well bore. This is referred to as a formation influx or kick, commonly called a well control incident or event. Conversely, a high BHP will present a risk of exceeding formation fracture pressures, with consequences such as lost circulation and loss of wellbore hydrostatic, and ultimately could also give rise to a formation influx or kick.

If an influx is not detected or responded to quickly enough, hydrocarbons can escape above the subsea blow out preventer (SSBOP) and into the riser. The infiltration of gas into the riser system creates an extremely hazardous situation, as the gas is now above the main safety barrier i.e. the subsea BOP and will continue to expand and increase in velocity as it migrates or circulates up the riser. This leads to the violent displacement/unloading and/or evacuation of the liquid volume from the riser. Ultimately, this could lead to an uncontrolled blow out of gas through the rig rotary table, which could be catastrophic to people, equipment and the environment as happened recently on the drilling rig 'Deepwater Horizon'.

As such, the goal of a conventional drilling system is to maintain the BHP above the pore pressure but below the fracture pressure while taking the ECD into account to manage the BHP. Depleted formation pressures and narrow drilling windows resulting from a tight margin between the pore pressure and fracture pressure are an ever increasing challenge in wells being drilled in offshore environments. The ability to drill these wells economically and safely relies on the techniques such as MPD, described above.

If a kick or influx is detected, offshore diverters are used in conventional underbalanced drilling to divert safely the flow of fluid and gas overboard or to the rig's conventional mud gas separator (MGS), in the event that gas manages to circulate or migrate above the subsea BOP. They are the last safety barrier present in the riser to seal off the riser annulus, and are located at the top of the riser directly below the rig rotary table. Once the diverter seals around the drill string or on the open riser with no pipe, all flow from the riser is routed through either the port or starboard diverter lines to safely divert flow away from the rig floor to the MGS, or overboard away from the rig.

The general design and operation of a common diverter used offshore is described in U.S. Pat. Nos. 4,971,148 and 4,566,494.

Referring now to FIG. 1, there is shown an exemplary embodiment of a simple cross section of a prior art diverter 10' used on floating installations for offshore drilling. The diverter 10' includes a diverter assembly mounted in a diverter support housing 18'. The diverter assembly includes a diverter housing 12' in which is mounted an annular elastomeric packer 14', and a hydraulically driven piston 16' which is movable by the supply of pressurised fluid to a close chamber (not shown) to force the packer 14' radially inwards around the central axis AA. The packer 14' may thus seal against a drill string extending through the housing diverter housing 12'. The hydraulic power is supplied by the control system of the diverter (not shown), and connects to the diverter through a plurality of interfaces using high pressure hydraulic lines, well known in the art.

The diverter housing 12' is mounted in passageway in a tubular diverter support housing 18' so that both share a common central vertical axis AA. The diverter support housing 18' is usually connected and supported by the rotary structural support beams 19' directly below the rig's rotary table, and is normally a permanent installation on the rig. The diverter support housing 18' is connected to the upper flex joint (not shown) of the riser via a crossover flange 22' on the bottom of the diverter support housing 18'.

At least one large diameter outlet port 28' is integrated into the diverter support housing 18', and normally two outlet ports are present to divert flow to either starboard or port side of the rig. The outlet ports 28' can be as large as 20 inches in outer diameter, with an inner diameter A of up to 18 inches. It should be appreciated, however, that these diameters vary between manufacturers, models, and the rig design within which the diverter 10 is installed. The or each outlet port 28' is connected to a remotely operated valve (not shown) which govern the flow of fluid from the outlet port 28'. In this embodiment, there is an additional side outlet 30' provided to connect a riser fill up or "fill" line 32' on the diverter support housing 18'.

Two flow line seals 34*a*', 34*b*' are provided between the exterior surface of the diverter housing 12' and the interior surface of the diverter support housing 18', one below the or each outlet port 28' and the other above. These seals may be O-rings or any other type of seal suitable for substantially preventing leakage of fluid from the outlet port 28' between the diverter housing 12' and the diverter support housing 18'.

During installation, the diverter housing 12' inserted into the diverter support housing 18' via a running tool (not shown) connected to its running tool profile 20'. Once the diverter housing 12 is landed on a landing shoulder profile 24' of the diverter support housing 18', it is locked into place using multiple locking dogs or pistons 26' situated radially around the diverter support housing 18'. It is appreciated that the mechanism for locking the diverter housing 12' in the diverter support housing 18' varies between manufacturers and models and may be mechanical or hydraulic, or a different type of mechanism such as J-locks well known in the art.

After the diverter housing 12' is locked into position, the upper and lower pressure energized flow line seals 34*a*', 34*b*' are activated when dynamic conditions are present. The flow line seals 34*a*', 34*b*' energize and seal when wellbore pressure is present below the closed packer 14, and as the pressure increases they compress against the housing walls, increasing their sealing effectiveness. These prevent fluid and/or gas leakage externally to the diverter housing 12' when wellbore pressure exists below the closed packer 14 during flow diversion through the side outlets 28'.

The outer diameter F of the diverter housing 12' is dictated by the internal diameter of the rig's rotary table, so that the diverter housing 10 can be lowered through the rotary table for its installation below in the diverter support housing 18'. For example, one of the smallest internal diameters for an offshore rotary table is 47 inches, so a common diverter housing 12' outer diameter F may be 46.75 inches.

The complete diverter housing 12' and the diverter support housing 18' has a total length E, and the length D of the support housing 18' is used in determining the rig's riser spaceout. Lengths B and C combined provide the distance from the base of the diverter support housing 18' to the connective support at the rotary beams. It is appreciated that all lengths B, C, D, E, the flow outlet diameter A, and the outer diameter F of the diverter housing 12' are governed by the rig design, and thus vary on a rig to rig basis. A common diverter system and its componentry is generally rated to a maximum of 500 psi working pressure.

Conventional diverters systems have their limitations, however. For example, a conventional diverter system cannot be operated while rotating the drill string, and generally the pressure rating of the system is low due to the lower pressure rating of the slip joint packer seals, the upper flex joint, and the valves and connections directly connected to the diverter housing. Even though the pressure rating of a conventional diverter and the upper flex joint can be up to 500 psi, in reality it is ensured that the system does not operate beyond atmospheric back pressure, by always having one line open through an interlock system. Thus the conventional system may only see higher pressures when a full uncontrolled unloading of the riser occurs, when it is possible that the pressure at the diverter may reach as high as 150 psi due to the backpressure of flow through the length of diverter line that is open. As these are usually 12 to 16 inches in diameter, it can be appreciated that the flow to create even 50 psi back pressure is tremendous.

Moreover the increasing pressure in the diverter housing as gas is circulated through the system could result in leaks through the conventional slip joint seals and upper flex joint leading to a gas release below the rig floor. Additionally, the time to close a diverter can vary from 20 to 30 seconds which may prove to be catastrophic if the kick detection time was slow or delayed and gas breakout is occurring near or at the surface.

Furthermore, if the volume and pressure of the gas present is such that there is a risk of overloading the rig's conventional MGS, flow is diverted overboard to the ocean. This does have an environmental impact, of course, and so is to be avoided, wherever possible.

MPO has developed a system and method described in previously filed patent WO2013153135 for the installation of a Riser Gas Handling (RGH) system. The RGH is an operating system for handling large influxes of gas in the riser and the resultant pressurized flow from the riser, and involves operating a rapidly closing riser closure apparatus the Quick Closing Annular (QCA) to seal off the riser at a point above a flow spool provided in the riser. Flow diverts through the flow spool to a pressure control valve provided in the riser gas handling manifold at surface which is used to control the diverted flow from the riser to a high capacity MGS at surface, where the gas is safely separated from the fluid in a controlled manner.

Thus, the riser is modified with a Quick Closing Annular (QCA), described in WO2013135725, and a flow spool with flow lines connected to a gas handling manifold. Riser closing times are improved to less than 5 seconds, and the installation of the RGH system below the rig's slip joint removes the slip joint as a pressure limiter and improves the pressure and gas handling capacity of the riser system when compared to a conventional diverter system. The RGH system allows larger volumes of riser gas to be controlled safely.

An alternative system and method is disclosed in patent application WO2011/104279. In this case, a riser closure device is installed at the top of the riser between the diverter and the slip joint. This position would allow for simplified installation, repair, maintenance, or replacement of sealing mechanism of the riser closure device without having to unlatch the lower marine riser package (LMRP) from the subsea BOP. Such is the case when they are installed below the rig's tensioner ring and/or below the water line, which results in added complexities and operational time to replacement or repair. However, installation of the riser closure device above the slip joint requires pressure compensation and corresponding return fluid flow correction during the heave cycles of the rig, because the slip joint becomes confined within the closed loop system. This includes a flow control device, a pressure damper system with a pressure regulator, and a slip joint displacement meter. Using this equipment, the change in the flow rate and the resultant pressure fluctuations from the extension and retraction of the slip joint during the heave cycle are compensated and corrected for.

This allows a constant pressure to be maintained within the riser and at the bottom of the well during drilling while under the influence of rig heave, while simultaneously correcting the outflow from the riser so that influx or loss events in the wellbore are not masked. This described configuration, its associated compensation system, and its methodology are known in the prior art.

As the slip joint becomes integrated into the closed loop system, a conventional slip joint is not effective in sealing against the increased riser pressure expected from MPD or riser gas handling operations. Thus a high pressure slip joint design is required to replace the conventional slip joint, such as the apparatus described in WO2012143723. This incorporates a multiple annular packer arrangement on the outer barrel housing which hydraulically seals against the transient inner barrel. The multiple seals and sealing mechanism allow the high pressure slip joint to effectively seal the riser annulus at higher pressures over the heave cycle during MPD and/or gas handling operations.

Various systems and methods have been proposed to utilize existing RCD designs such that the offshore rig can be converted between a surface annular BOP/diverter for conventional drilling operations and a rotating pressure control device for pressurized drilling operations such as MPD. This is advantageous due to the increasing demand for MPD and other pressurized drilling techniques required to drill increasingly complex wells in deep water environments. Furthermore, it would be beneficial to have the capability to rotate with the diverter seals close—such as slow rotation to prevent sticking or stuck drill string while circulating out riser gas, and/or minimizing annular pressure losses after circulating out the riser gas and before continuing with drilling operations. Such systems and methods are disclosed in US2009/0101351 and US2008/0210471.

In US2008/0210471 the installation of a bell nipple or other housing assembly below the existing diverter housing is required, the bell nipple/other housing assembly to be used as a docking station for an RCD bearing assembly. With the RCD bearing assembly latched into place in the housing, pressurized drilling operations are permitted, and to revert to conventional drilling the bearing assembly is retrieved. It includes its own slip joint to operate on a floating installation and thus the existing riser slip joint is replaced, resulting in a system that requires changes to the spaceout and configuration of the prevailing riser. Additionally, the bearing assembly must be removed to pass larger outer diameter (OD) components through the housing/docking station. The rig's diverter system remains active with the conventional diverter insert in place and the docking station/RCD installed below.

Another apparatus, disclosed in patent application WO99/51852, describes a diverter head used on a subsea wellhead to divert flow using a combination of a passive and active sealing mechanism—a stripper rubber seal and a gripper seal—which rotate with the drill string.

US2009/0101351 progresses this concept further, and proposes a system and method that utilizes the existing diverter system with an RCD. A universal marine diverter converter (UMDC) eliminates the need to remove the diverter insert/seal assembly from the diverter housing, and it is not required to change the spaceout or configuration of the current riser. The RCD housing is clamped or latched together with the UMDC housing and has an upper and lower section. These sections are attached together via a thread or another means, which allows the UMDC to be configured to the size and type of diverter housing present. The lower housing consists of a cylindrical "stinger" which extends downwards across the diverter annular packer and allows the drill string to pass through its internal profile rotating or reciprocating. The diverter's annular packer is closed on the cylindrical body to hold the UMDC housing in place, while the RCD provides the necessary seal for rotation and reciprocation of the drill string. Ejection of the bearing assembly under pressure is prevented by the larger diameter holding member on the end of the cylindrical stinger below the sealing point of the diverter packer.

With the UMDC in position, the rig is MPD-UBD enabled allowing pressurized drilling operations to proceed, while also permitting drill string rotation during the handling of gas from the riser—thus it provides a dual purpose sealing solution. With this system, the ability to seal the riser with the diverter annular packer is lost as its main function is to assist in holding the UMDC in position via the holding member—if the sealing element starts to leak there is only the subsea BOP as a contingency, which is of no assistance if gas is at the top of the riser. Historically, it has been challenging to monitor the condition of the RCD sealing elements with respect to wear and proximity to failure, which raises concerns with the UMDC in a riser gas situation if the RCD has been in service for some time. Furthermore, as with the previous concept, the UMDC must be removed to pass larger OD drill string components.

The need exists to progress the evolution of offshore diverter technology, as it has changed very little in the last two decades with respect to pressure capacity and closure speed. There is an increasing need for a rapid closing and higher pressure rated diverter system for added safety on the rig to control and remove riser gas and drill increasingly challenging reservoirs. There is a need for such a system which can be integrated into existing offshore diverter systems, requiring minimal modifications to the existing riser system, and achievable without altering the prevailing spaceout. With the increasing requirements of pressurized drilling techniques in offshore environments, there is a need for an efficient system to safely convert existing diverter infrastructure into an MPD-capable closed loop system utilizing a more reliable sealing technology than prior arts within the diverter. It is preferred that the inventive system and method has compatibility with common diverter models used offshore. For new build rigs, the configuration described here can be used to replace the existing atmospheric diverter design with this improved system and method.

It is an object of the system described in this application to provide an alternative, possibly more cost effective; diverter system which is capable of operating at the pressures experienced in MPD, which may be simpler to install and which does not require the need to change the rig's riser space out, and therefore may more readily be integrated into existing systems.

According to a first aspect of the invention we provide a drilling system including a riser, a pressure vessel, a source of pressurised gas, and a main flow line which extends from the riser to the pressure vessel, the pressure vessel having a liquid inlet port connected to the main flow line, a gas inlet port connected to the source of pressurised gas, a liquid outlet port located in a lowermost portion of the pressure vessel, and a gas outlet port located in an uppermost portion of the pressure vessel.

The gas inlet port may be provided in an uppermost portion of the pressure vessel.

The system preferably also includes a liquid pressure control valve which is operable to control the flow of liquid out of the pressure vessel via the liquid outlet port.

The system preferably also includes a gas pressure control valve which is operable to control the flow of gas out of the pressure vessel via the gas outlet port.

The system may also include a mud gas separator which has a liquid inlet port to which the liquid outlet port of the pressure vessel is connected by means of a liquid flow line. In this case the liquid pressure control valve may be provided in the liquid flow line.

Where the system includes a mud gas separator, the mud gas separator may have a gas inlet port to which the gas outlet port of the pressure vessel is connected by means of a vent line. In this case the gas pressure control valve may be provided in the vent line.

A valve may be provided in a line connecting the source of pressurised gas to the gas inlet port of the pressure vessel.

A secondary pressure control valve may be provided in the main flow line.

The main flow line may be connected to the riser via a diverter.

The diverter may include a diverter assembly which is operable to close around a drill string extending down the riser to contain pressure in the annulus of the riser around the drill string. In this case, preferably the diverter closes around the drill string above the connection to the main flow line. The diverter assembly is preferably operable to close around a drill string extending down the riser to contain pressure in the annulus of the riser around the drill string whilst allowing the drill string to rotate about its longitudinal axis.

The diverter assembly may be mounted in a diverter support housing which is adapted, in use, to be suspended from a rig floor.

A slip joint may be provided in the riser below the connection to the main flow line.

The source of pressurised gas may comprise a bottle of compressed nitrogen.

The system may further include a pressure sensor which is operable to provide an output indicative of the pressure of the gas in the uppermost region of the pressure vessel.

The system may further include a liquid level sensor which is operable to provide an output indicative of the level of the liquid in the pressure vessel.

According to a second aspect of the invention we provide a method of operating a drilling system including a riser, a pressure vessel, a source of pressurised gas, and a main flow line which extends from the riser to the pressure vessel, the pressure vessel having a liquid inlet port connected to the main flow line, a gas inlet port connected to the source of pressurised gas, a liquid outlet port located in a lowermost portion of the pressure vessel, a liquid pressure control valve which is operable to control the flow of liquid out of the vessel via the liquid outlet port, a gas outlet port located in an uppermost portion of the pressure vessel, and a gas pressure control valve which is operable to control the flow of gas out of the vessel via the gas outlet port, wherein the method includes the steps of operating one or both of the liquid pressure control valve and gas pressure control valve to control the pressure in the riser.

The method may include the steps of opening both the gas pressure control valve and liquid pressure control valve so as to decrease the degree to which the valves restrict flow of fluid out of the vessel in order to decrease the pressure in the riser, or closing both the gas pressure control valve and liquid pressure control valve so as to increase the degree to which the valves restrict flow of fluid out of the vessel in order to increase the pressure in the riser.

The system may also include a mud gas separator which has a liquid inlet port to which the liquid outlet port of the pressure vessel is connected by means of a liquid flow line. In this case the liquid pressure control valve may be provided in the liquid flow line.

Where the system includes a mud gas separator, the mud gas separator may have a gas inlet port to which the gas outlet port of the pressure vessel is connected by means of a vent line. In this case the gas pressure control valve may be provided in the vent line.

A secondary pressure control valve may be provided in the main flow line, and the method may include the steps of operating the secondary pressure control valve to control the pressure in the riser and operating the liquid pressure control valve and/or the gas pressure control valve to bring the pressure in the pressure vessel to a desired level, and then opening the secondary pressure control valve to decrease the extent to which it restricts the flow of fluid along the main flow line, before operating the liquid pressure control valve and/or gas pressure control valve to control the pressure in the riser.

The system may include a gas supply valve which controls the flow of gas from the source of pressurised gas into the pressure vessel, and method may further include the step of opening the gas supply valve after closing the gas pressure control valve and the secondary pressure control valve.

The main flow line may be connected to the riser via a diverter.

The diverter may include a diverter assembly, and the method may include operating the diverter assembly to close around a drill string extending down the riser to contain pressure in the annulus of the riser around the drill string. Preferably this is done prior to operating the gas pressure control valve and/or liquid pressure control valve, or, where provided, the secondary pressure control valve. In this case, preferably the diverter closes around the drill string above the connection to the main flow line. The diverter assembly is preferably operable to close around a drill string extending down the riser to contain pressure in the annulus of the riser around the drill string whilst allowing the drill string to rotate about its longitudinal axis.

The diverter assembly may be mounted in a diverter support housing which is adapted, in use, to be suspended from a rig floor.

A slip joint may be provided in the riser below the connection to the main flow line.

The source of pressurised gas may comprise a bottle of compressed nitrogen.

The system may further include a pressure sensor which is operable to provide an output indicative of the pressure of the gas in the uppermost region of the pressure vessel, and the method may include using the output of the pressure sensor to determine how to operate the gas pressure control valve and/or the liquid pressure control valve.

The system may further include a liquid level sensor which is operable to provide an output indicative of the level of the liquid in the pressure vessel, and the method may include using the output of the gas pressure sensor to determine how to operate the liquid pressure control valve.

According to a third aspect of the invention we provide a method of operating a drilling system including a riser, a pressure vessel, a source of pressurised gas, and a main flow line which extends from the riser to the pressure vessel, the pressure vessel having a liquid inlet port connected to the main flow line, a gas inlet port connected to the source of pressurised gas, a liquid outlet port located in a lowermost portion of the pressure vessel, a liquid pressure control valve which is operable to control the flow of liquid out of the vessel via the liquid outlet port, a gas outlet port located in an uppermost portion of the pressure vessel, a gas pressure control valve which is operable to control the flow of gas out of the vessel via the gas outlet port, and a secondary pressure control valve which is located in the main flow line, wherein the method includes the steps of closing the secondary pressure control valve so as to increase the extent to which it restricts flow of fluid along the main flow line, and closing the gas pressure control valve so as to increase the extent to which it restricts flow of fluid out of the pressure vessel via the gas outlet port, using the output of the pressure sensor to determine when the pressure in the pressure vessel is approximately equal to the pressure in the main flow line upstream of the secondary pressure control valve, and opening the secondary pressure control valve when the pressure in the pressure vessel is generally equal to the pressure in the main flow line.

The system may include a gas supply valve which controls the flow of gas from the source of pressurised gas into the pressure vessel, and method may further include the step of opening the gas supply valve after closing the gas pressure control valve and the secondary pressure control valve.

The method may include the steps of operating the liquid pressure control valve and/or the gas pressure control valve to control the pressure in the riser.

The method may include the steps of opening both the gas pressure control valve and liquid pressure control valve so as to decrease the degree to which the valves restrict flow of fluid out of the gas pressure vessel in order to decrease the pressure in the riser, or closing both the gas pressure control valve and liquid pressure control valve so as to increase the degree to which the valves restrict flow of fluid out of the pressure vessel in order to increase the pressure in the riser.

The system may also include a mud gas separator which has a liquid inlet port to which the liquid outlet port of the pressure vessel is connected by means of a liquid flow line. In this case the liquid pressure control valve may be provided in the liquid flow line.

Where the system includes a mud gas separator, the mud gas separator may have a gas inlet port to which the gas outlet port of the pressure vessel is connected by means of a vent line. In this case the gas pressure control valve may be provided in the vent line.

The main flow line may be connected to the riser via a diverter.

The diverter may include a diverter assembly, and the method may include operating the diverter assembly to close around a drill string extending down the riser to contain pressure in the annulus of the riser around the drill string. Preferably this is done prior to operating the gas pressure control valve and liquid pressure control valve. In this case, preferably the diverter closes around the drill string above the connection to the main flow line. The diverter assembly is preferably operable to close around a drill string extending down the riser to contain pressure in the annulus of the riser around the drill string whilst allowing the drill string to rotate about its longitudinal axis.

The diverter assembly may be mounted in a diverter support housing which is adapted, in use, to be suspended from a rig floor.

A slip joint may be provided in the riser below the connection to the main flow line.

The source of pressurised gas may comprise a bottle of compressed nitrogen.

The system may further include a pressure sensor which is operable to provide an output indicative of the pressure of the gas in the uppermost region of the pressure vessel, and the method may include using the output of the pressure sensor to determine how to operate the gas pressure control valve and/or the liquid pressure control valve.

The system may further include a liquid level sensor which is operable to provide an output indicative of the level of the liquid in the pressure vessel, and the method may include using the output of the pressure sensor to determine how to operate the liquid pressure control valve.

According to a fourth aspect of the invention we provide a diverter for diverting fluid from a riser in a drilling system, the diverter comprising a diverter support housing having a suspension structure by means of which the diverter support housing may be suspended from a drilling rig, a main passage which extends from an uppermost end of the diverter support housing to a lowermost end, a diverter housing which is located in the main passage of the diverter support housing, there being mounted within the diverter housing an annular packer element and actuator which is operable to force the annular packer into sealing engagement with a drill string extending through the main passage of the diverter support housing, the diverter being further provided with a seal locking mechanism which is operable to retain a tubular sealing element in the diverter housing adjacent to the packer element.

Advantageously, the locking mechanism is retractable, i.e. movable between an operative position in which it extends from the diverter housing into the main passage, and an inoperative position, in which it is retracted into the diverter housing so that it no longer extends into the main passage. In this case, the diverter may include a fluid pressure operating system which is configured such that movement of the locking mechanism between the operative and inoperative position occurs by means of the supply of pressurised fluid to the fluid pressure operating system.

The locking mechanism may comprise a first locking element and a second locking element are spaced longitudinally along the main passage so that a tubular sealing element may be retained between the first locking element and second locking element when they are in their operative positions.

The diverter support housing may further include a landing shoulder which extends into the main passage at a lowermost end of the diverter support housing, the diverter housing engaging with the landing shoulder so that the landing shoulder prevents further movement of the diverter housing in a first direction along the main passage.

The diverter support housing and diverter housing are preferably provided with a side passage which extends from the exterior of the diverter support housing into the main passage.

The diverter may be provided with a seal which provides a fluid tight seal between the interior face of the diverter support housing and an exterior surface of the diverter housing. Where the diverter support housing and diverter housing are provided with a side passage, the diverter preferably includes two such seals, the side passage being located between the two seals so that the seals substantially prevent leakage of fluid from the side port between the diverter support housing and the diverter housing.

The seals are preferably circular and located in a circular groove around the exterior surface of the diverter housing.

The actuator may comprise a piston which is movable generally parallel to the longitudinal axis of the main passage to urge the packer element into sealing engagement with a drill string extending along the main passage.

The diverter may be provided with a further locking mechanism whereby the diverter housing may be secured in the diverter support housing. In this case, the further locking mechanism may comprise a hydraulically operable locking element which is movable into an operative position in which it extends from the diverter support housing into a corresponding groove or aperture in the diverter housing.

According to a fifth aspect of the invention we provide a diverter assembly comprising a diverter for diverting fluid from a riser in a drilling system, and a control apparatus, the diverter comprising a diverter support housing having a suspension structure by means of which the diverter support housing may be suspended from a drilling rig, a main passage which extends from an uppermost end of the diverter support housing to a lowermost end, a diverter housing which is located in the main passage of the diverter support housing, there being mounted within the diverter housing an annular packer element and actuator, the actuator dividing the interior of the diverter housing into two chambers, namely an open chamber and a close chamber, substantially preventing flow of fluid between the two chambers, and being movable, by means of the supply of pressurised fluid to the close chamber, to urge the packer element into sealing engagement with a drill pipe extending through the diverter, the control apparatus including a close line which extends from the exterior of the housing to the close chamber, and a source of pressurised fluid which is connected to the close line, wherein the source of pressurised fluid is located adjacent to the diverter housing.

Preferably the source of pressurised fluid is less than 15 foot from the close chamber The source of pressurised fluid preferably comprises at least one accumulator.

Advantageously, the control apparatus further comprises a close control valve which is located in the close line between the source of pressurised fluid and the close chamber, the close control valve being movable between an open position in which flow of fluid from the source of pressurised fluid to the close chamber is permitted, and a closed position in which flow of fluid from the source of pressurised fluid to the close chamber is substantially prevented.

The source of pressurised fluid is advantageously so close to the housing that the time between opening the close control valve and closing of the blow out preventer is 3 seconds or less where a drill string is present in the blowout preventer or 5 seconds or less where there is no drill string present in the blowout preventer.

The close control valve is preferably electrically or electronically operable. In this case, the control valve may move from the closed to position to the open position when supplied with electrical power.

Supply of electrical power to the close control valve may be controlled by an electronic control unit which is remote from the blow out preventer and control apparatus.

The control apparatus may further comprise a pump which has an inlet which draws fluid from a fluid reservoir and an outlet which is connected to the close line.

The control apparatus may further comprise an open line which extends from the exterior of the housing to the open chamber.

The pump may be connected to the open line in addition to the close line. In this case, the control apparatus advantageously includes a further valve which is movable from an open configuration in which flow of fluid from the pump to the close line is permitted whilst flow of fluid from the pump to the open line is substantially prevented, and a closed configuration in which flow of fluid from the pump to the open line is permitted whilst flow of fluid from the pump to the close line is substantially prevented.

The open line may be provided with an exhaust valve which is located adjacent to the housing, and which is movable between a first position in which flow of fluid along the open line into the open chamber is permitted, and a second position in which the open line is substantially blocked upstream of the exhaust valve relative to the open chamber, and the open chamber is connected to a low pressure region.

The low pressure region may be the atmosphere at the exterior of the housing.

The low pressure region may comprise an exhaust conduit which has a greater cross-sectional area than the open line, and which is connected to a fluid reservoir.

The close line may be at least 2 inches in diameter.

The open line may be at least 2 inches in diameter.

According to a sixth aspect of the invention we provide A diverter assembly comprising a diverter for diverting fluid from a riser in a drilling system, and a control apparatus, the diverter comprising a diverter support housing having a suspension structure by means of which the diverter support housing may be suspended from a drilling rig, a main passage which extends from an uppermost end of the diverter support housing to a lowermost end, a diverter housing which is located in the main passage of the diverter support housing, there being mounted within the diverter housing an annular packer element and actuator, the actuator dividing the interior of the diverter housing into two chambers, namely an open chamber and a close chamber, substantially preventing flow of fluid between the two chambers, and being movable, by means of the supply of pressurised fluid to the close chamber, to urge the sealing element into sealing engagement with a drill pipe extending through the diverter, wherein the control apparatus includes an exhaust valve which is located adjacent to the housing, and which is movable between a first position in which flow of fluid along the open line into the open chamber is permitted, and a second position in which the open line is substantially blocked upstream of the exhaust valve relative to the open chamber, and the open chamber is connected to a low pressure region.

The low pressure region may be the atmosphere at the exterior of the housing.

The low pressure region may comprise an exhaust conduit which has a greater cross-sectional area than the open line, and which is connected to a fluid reservoir.

The diverter assembly according to the sixth aspect of the invention may have any of the features of the diverter assembly according to the fifth aspect of the invention.

BRIEF DESCRIPTION OF THE DRAWINGS

Embodiments of the invention will now be described, by way of example only, with reference to the accompanying drawings of which

Referring now to FIG. 2, this shows one embodiment of diverter 10 according to the invention. As in the prior art diverter 10' illustrated in FIG. 1, the diverter 10 includes a diverter assembly which is mounted in passageway in the existing tubular diverter support housing 18 so that both share a common central vertical axis AA. The diverter support housing 18 is the same as the prior art diverter support housing 18' illustrated in FIG. 1, which remains connected and supported by the rotary structural support beams 19 directly below the rig's rotary table. As in the prior art, the diverter support housing 18 is connected to the upper flex joint (not shown) of the riser via a crossover flange 22 on the bottom of the diverter support housing 18.

Figure 1:
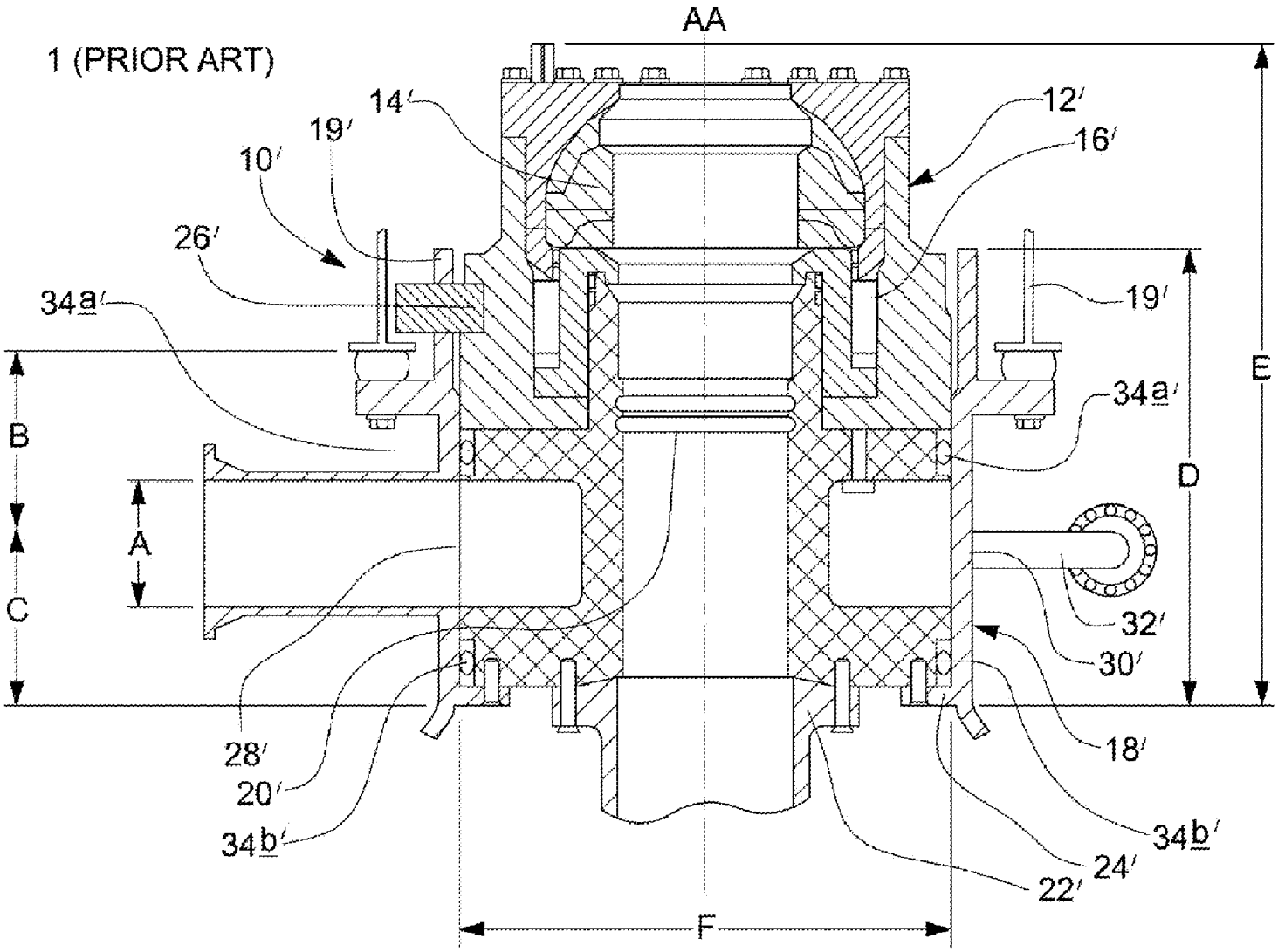
FIG 1 (PRIOR ART)
FIG. 1 shows an exemplary embodiment of a simple cross section of a prior art diverter.

At least one large diameter outlet port 28 is integrated into the diverter support housing 18, and normally two outlet ports are present to divert flow to either starboard or port side of the rig. The outlet ports 28 can be as large as 20 inches in outer diameter, with an inner diameter A of up to 18 inches. It should be appreciated, however, that these diameters vary between manufacturers, models, and the rig design within which the diverter 10 is installed. The or each outlet port 28 is connected to a remotely operated valve (not shown) which governs the flow of fluid from the outlet port 28.

Two flow line seals 34*a*, 34*b* are provided between the exterior surface of the diverter housing 12 and the interior surface of the diverter support housing 18, one below the or each outlet port 28 and the other above. These seals may be O-rings or any other type of seal suitable for substantially preventing leakage of fluid from the outlet port 28' between the diverter housing 12 and the diverter support housing 18.

The diverter assembly is designed to replace the prior art diverter assembly illustrated in FIG. 1, and is designed to seat and seal within the internal profile of the existing diverter support housing 18. Thus, the diverter assembly includes identical mechanical features as the prior art diverter assembly, such as the upper and lower pressure energized seals 34*a*, 34*b* and an identical profile for locking it into position within the support housing 18 utilizing the existing locking dog 26.

The diverter assembly is as close as possible to the outside diameter and external profile of the prior art diverter assembly insert, allowing it to drift through the rotary table and accurately land out on the shoulder 24 within the existing diverter support housing 18. This results in the correct alignment of the pressure energized flow line seals 34*a*, 34*b* and locking profile of the diverter assembly. For example, if the total length of the original diverter assembly was 80 inches with an outer diameter of 46.75 inches, the QCA diverter assembly 5 should be as close as possible to its dimensions to satisfy the mechanical tolerances required so successfully seat, align, and lock in the diverter support housing 18.

Also, just as in the prior art the complete diverter housing 12 and the diverter support housing 18 has a total length E, and the length D of the support housing 18 is used in determining the rig's riser spaceout. Lengths B and C combined provide the distance from the base of the diverter support housing 18 to the connective support at the rotary beams. It is appreciated that all lengths B, C, D, E, the flow outlet diameter A, and the outer diameter F of the diverter housing 12 are governed by the rig design, and thus vary on a rig to rig basis.

As in the prior art, the outer diameter F of the diverter housing 12 is dictated by the internal diameter of the rig's rotary table, so that the diverter housing 10 can be lowered through the rotary table for its installation below in the diverter support housing 18. For example, one of the smallest internal diameters for an offshore rotary table is 47 inches, so a common diverter housing 12 outer diameter F may be 46.75 inches. It should be appreciated, however, that the outside diameter of the diverter assembly will vary to accommodate the prevailing design of the diverter support housing 18 on the offshore installation. Thus, the outer diameter of the diverter assembly is not limited to 46.75 inches. For example, if the rotary table internal diameter is 49.5 inches and the original diverter assembly outside diameter is 49.25 inches, the replacement diverter assembly is required to have a similar dimensional design so that it accurately lands and seals within the existing diverter support housing 18. These specific mechanical tolerances need to be satisfied for the efficacy of its operation.

As before, the diverter assembly includes a diverter housing 12 in which is mounted an annular elastomeric packer 14, and a hydraulically driven piston 16 which is movable by the supply of pressurised fluid to a close chamber (not shown) to force the packer 14 radially inwards around the central axis AA. The packer 14 may thus seal against a drill string extending through the housing diverter housing 12. The hydraulic power is supplied by the control system of the diverter (not shown), and connects to the diverter through a plurality of interfaces using high pressure hydraulic lines, well known in the art.

During installation, the diverter housing 12 inserted into the diverter support housing 18 via a running tool (not shown) connected to its running tool profile 20. Once the diverter housing 12 is landed on a landing shoulder profile 24 of the diverter support housing 18, it is locked into place using multiple locking dogs or pistons 26 situated radially around the diverter support housing 18. It is appreciated that the mechanism for locking the diverter housing 12 in the diverter support housing 18 varies between manufacturers and models and may be mechanical or hydraulic, or a different type of mechanism such as J-locks well known in the art.

After the diverter housing 12 is locked into position, the upper and lower pressure energized flow line seals 34*a*, 34*b* are activated when dynamic conditions are present. The flow line seals 34*a*, 34*b* energize and seal when wellbore pressure is present below the closed annular packer 14, and as the pressure increases they compress against the housing walls, increasing their sealing effectiveness. These prevent fluid and/or gas leakage externally to the diverter housing 12 when wellbore pressure exists below the closed annular packer 14 during flow diversion through the side outlets 28.

This diverter assembly differs from the prior art diverter 10' illustrated in FIG. 1 in that it also includes a seal locking mechanism which is operable to support a seal sleeve 36 in the diverter housing 12. In this example, the seal sleeve 36 is a tubular sealing element 36*a* contained within two annular support plates 36*b*, 36. The sealing element 36 may be a combined elastomeric and non-elastomeric composite as described in more detail in WO2011/128690. A co-molding process of the different materials into a honeycomb/hatched structure provides the sealing element 36*a* with desirable high strength and low wear rate characteristics of the sealing element 36*a*.

The seal locking mechanism is operable to retain a tubular element within the diverter housing 12 directly adjacent the packer 14. Advantageously, the seal locking mechanism, when not in use, can be withdrawn into the diverter housing so as not to reduce the inner diameter of the diverter housing, permitting full bore access to the riser below. In this example, the seal locking mechanism comprises upper and lower hydraulically actuated locking dogs 38*a*, 38*b*, which are situated radially around the common central axis AA. Each set of locking dogs 38*a*, 38*b* is a plurality of pistons which extend a small fraction of the total lateral distance inwards towards the central axis AA. In this example the locking dogs 38*a*, 38*b* can be fully retracted within the diverter housing 12. The extension and retraction of the locking dogs 38*a*, 38*b* is possible through hydraulic fluid volume and pressure delivered through hydraulic lines and connections from the control system (not shown). The control system also supplies the hydraulic opening and closing pressure for the piston 16 which drives the elastomeric packer 14.

In one embodiment of the invention, hydraulic connections from the control system (not shown) to the diverter assembly are supplied by a connection block located on the diverter assembly. It is appreciated that other means of connecting the hydraulic control lines from the control system to the diverter assembly 5 are possible.

In this embodiment, the main function of the upper and lower locking dogs 38*a*, 38*b* is to provide the landing shoulder for the seal sleeve 36 and to prevent its vertical movement within the diverter assembly while it is in operation.

The seal sleeve 36 is typically inserted into the diverter housing 12 after it is landed and locked in position in the diverter support housing 18. Hydraulic pressure is then supplied to the closing chamber (not shown) of the lower locking dogs 38*b* and extends these locking dogs 38*b* inwards from the diverter housing 12 towards the common central axis AA, such that the lower support plate 36*b* of the seal sleeve lands out on the locking dogs 38*b*. The lower dogs 38*b* thus provide both a landing shoulder and sleeve support mechanism while assisting in securing the seal sleeve 36 within the diverter housing 12.

The seal sleeve 36 is secured and locked within the diverter housing 12 by extending the upper locking dogs 38*a*. Hydraulic pressure supplied to the closing chamber (not shown) of the upper locking dogs 38*a* extends the locking dogs 38*a* inwards from the diverter housing 12 towards the common central axis AA, such that the top surface of the upper support plate 36*b* of the seal sleeve 36 is adjoined to the lower surface of the upper locking dogs 38*a*. The upper locking dogs 38*a* thus provide the final locking mechanism with the lower locking dogs 38*b* after the seal sleeve 36 is inserted, preventing its vertical movement within the diverter housing 12.

When the sleeve is not in position, the upper and lower locking dogs 38*a*, 38*b* are retracted and full bore access to the riser is regained.

Figure 2:
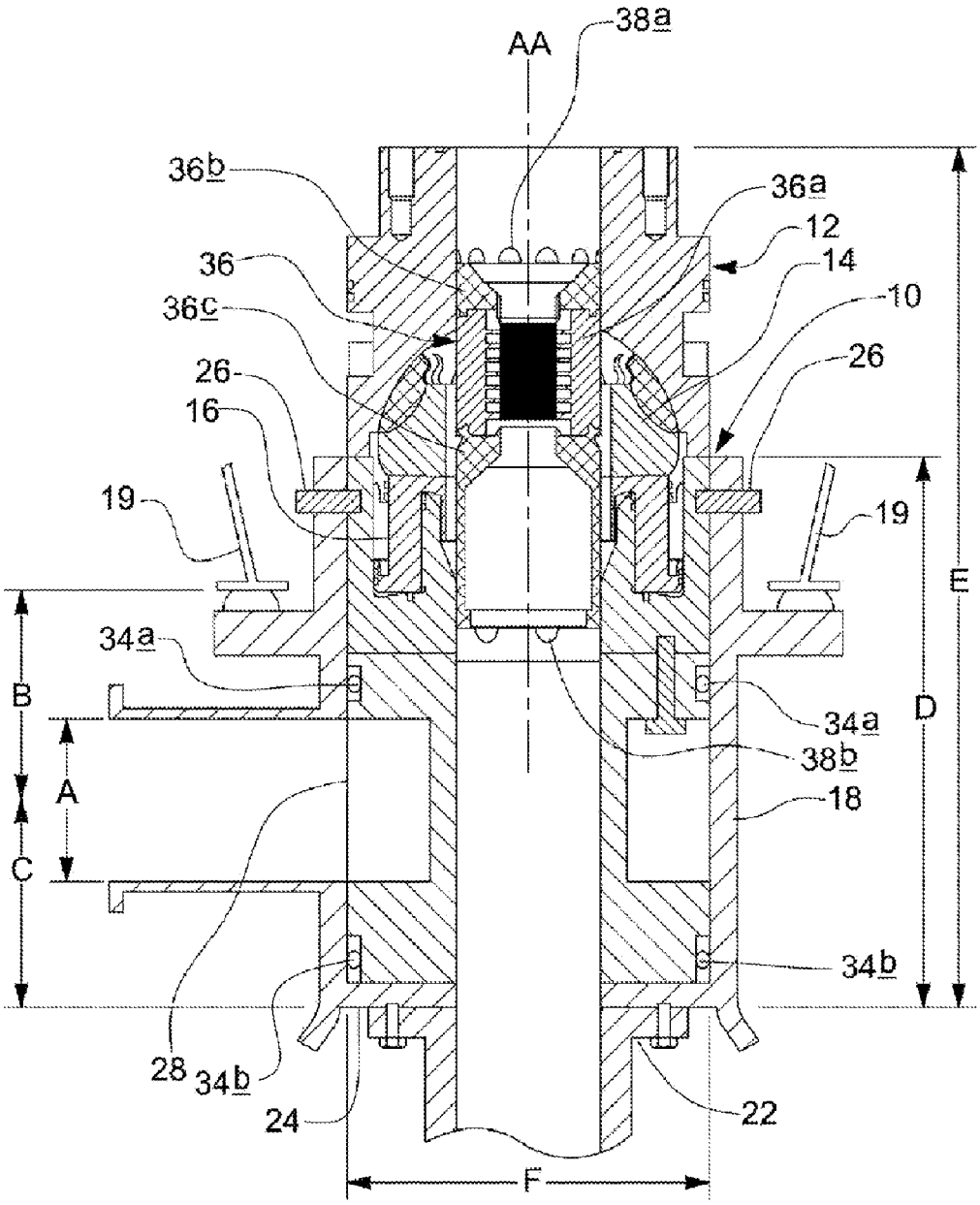
FIG. 2 shows a longitudinal cross-section through an embodiment of diverter according to the invention.

FIG. 2 illustrates the seal sleeve 36 landed and secured in position in a non-energized state, without a drill string extending through the diverter assembly. It is appreciated in these conditions that a drill string can drift through the seal sleeve's 36 internal bore without contacting the sealing element 36*a*, and that tool joints can drift through the sleeve 36*a* with minimal surface contact.

In this embodiment of the invention, drill string rotation is permitted when hydraulic fluid volume and pressure are supplied to close the packer 14, forcing it inwards, contacting the seal sleeve 36, and applying pressure radially on the external surface of the sealing element 36*a*. Once the sealing element 36 contacts the drill string, the drill string can be rotated while pressure integrity is sustained.

It should be appreciated that the diverter assembly need not include a seal sleeve, but in this case, movement of the drill string is limited to vertical motion, with rotation of the pipe not allowed.

It should be appreciated that the sealing pressure produced by the closing pressure of the hydraulic control system may be at least equal to or greater than the wellbore pressure present below the sealing point. It is also appreciated that the seal produced is a non-rotating seal within which the drill string rotates while the seal sleeve 36 remains stationary in the diverter housing 12, as described in the prior art.

With the seal sleeve 36 closed on the drill string, the capabilities to implement pressurized drilling techniques such as MPD are immediate. Furthermore, during riser gas incidents, drill string can continue to be rotated to minimize the risk of stuck pipe during circulations which can last for hours. This aspect also differs from the prior arts for rotating diverters, with respect to the application of its non-rotating seal versus a rotating seal described in the prior art.

Figure 3:
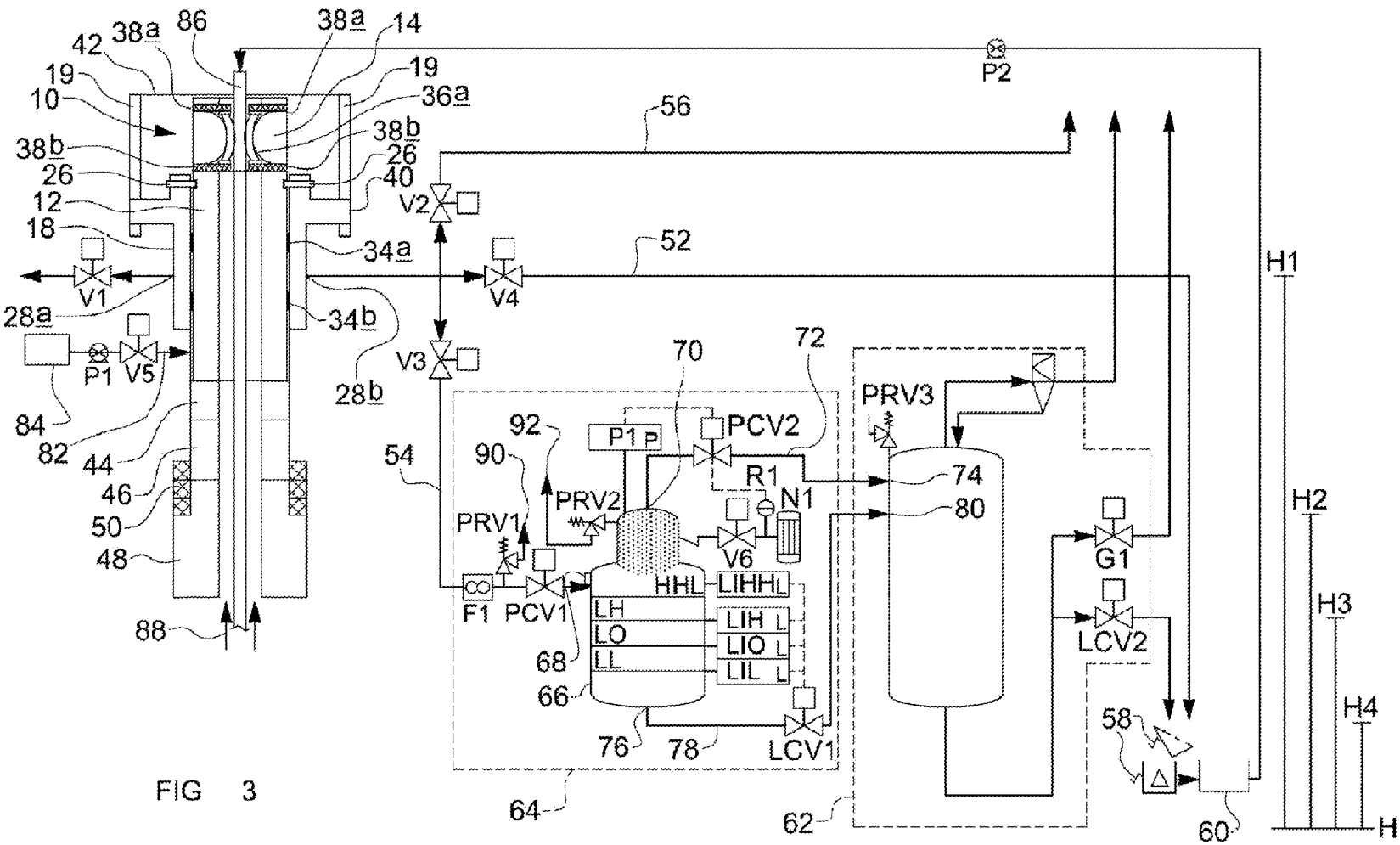
FIG. 3 shows a process flow diagram illustrating a drilling system according to the invention.

Referring now to FIG. 3, this shows a process flow diagram for a drilling system which incorporates the diverter 10 described above.

An existing diverter support housing 18 on an offshore floating installation, such as a drill ship or semi-submersible, is connected to and supported by the rotary support beams 19 at a connection point 40 on the diverter support housing 18 below the rotary table 42. The diverter support housing 18 connects to the upper flex joint 44 via a crossover flange on the bottom of the diverter support housing 18. The upper flex joint 44 is connected to the top of the inner barrel 46 of the slip joint, and the slip joint is comprised of the inner 46 and outer barrel 48 and the multiple packer seal arrangement 50.

An injection line extends from a reservoir of lubricant (which may be clean drilling fluid) to the portion of the riser between the diverter 10 and the upper flex joint 44. A pump P1 is provided to pump lubricant into the riser via a valve V5.

The two large diameter flow outlet ports 28*a*, 28*b* are connected to diverter flow lines, routing flow to either the starboard or port side of the rig. In one embodiment, the line from the starboard outlet port 28*a* is provided with a starboard diverter valve V1, and extends to a point remote from the rig floor where gas can be discharged relatively safely, if need be. In this embodiment, the line from the port side outlet port 28*b* extends to a T piece spool where it divides into a main diverter flow line 52, a MGS diverter line 54, and a port vent line 56.

The port vent line 56 extends to a point remote from the rig floor where it is relatively safe to discharge gas, if need be, and is provided with a port side vent valve V2 which is operable to permit or substantially prevent flow of fluid along the diverter vent line 56. The main diverter flow line 52 extends to a conventional shaker/degasser/centrifuge system 58, from which fluid discharged to the rigs mud pits 60 and is provided with a port side diverter valve V4 which is operable to permit or substantially prevent flow of fluid along the main diverter flow line 52. The MGS diverter line 54 extends to a mud gas separator (MGS) 62, and is provided with a MGS diverter valve V3 which is operable to permit or substantially prevent flow of fluid along the MGS diverter flow line 54. Once the diverter assembly is closed, the routing of the diverted flow path from the riser is determined through remote functioning of the starboard diverter valve V1, the port side diverter valve V2, or the high capacity MGS 426 diversion line valve V3.

The MGS 62 could be a conventional mud gas separator, or the new design of mud gas separator proposed in our co-pending UK patent application.

The drilling system also includes a pressure damper system 64 having a pressure vessel 66, the design capacity of which must not infringe on the existing design capacity of the MGS 62. In one embodiment of the invention the vessel 426 is basically a vertical cyclonic separator 426, with a smaller elongated cylindrical upper volume containing a compressed atmospheric air volume above its fluid level, or alternately the precharge nitrogen N1 at volume $V_{N2}$ and pressure $P_{N2}$.

It is appreciated a different vessel design may be utilized with the inventive method and system.

In this embodiment of the invention, the pressure vessel 66 has a liquid inlet port hereinafter referred to as the damper inlet port 68 which is connected to the MGS diverter line 54. A flow meter F1 is provided in the MGS diverter line downstream of the MGS diverter valve V3, and a first pressure relief valve PRV1 and a damper pressure control valve PCV1 are provided between the flow meter F1 and the damper inlet port 68.

The pressure vessel 66 is also provided with a gas outlet port, hereinafter referred to as the vent port 70 in a top portion of the pressure vessel 66, the vent port 70 being connected to a vent line 72. The vent line 72 extends to a gas inlet 74 of the MGS 62, and is provided with a gas pressure control valve, hereinafter referred to as vent pressure control valve PCV2 which is operable to permit or prevent flow of fluid along the vent line 72 to a greater or lesser extent. A pressure sensor PT is provided to measure the pressure ($P_{N2}$) at the top of the pressure vessel 66, and has an output which is connected to the vent pressure control valve PCV2.

The bottom of the pressure vessel 66 is provided with a liquid outlet port, hereinafter referred to as liquid drain port 76 which is connected to a liquid drain line 78. The liquid drain line 78 extends to a liquid inlet 80 of the MGS 62, and is provided with a liquid pressure control valve LCV1 which is operable to permit or prevent flow of fluid along the liquid drain line 78 to a greater or lesser extent.

The damper system 64 is also provided with a reservoir of compressed (or pressurised) gas (typically nitrogen) N1 which is connected to a gas inlet port in the top or uppermost portion of the pressure vessel 66 via a pressure regulator R1 and a valve V6.

A conventional liquid level sensor apparatus is provided to measure the liquid level in the pressure vessel 66. This may be a sonar or laser type level sensor. The level sensor is coupled with conventional level switches with set points for high fluid level LH, operating fluid level LO and low fluid level LL. The level sensor is connected to a central control system. It may transmit a level signal to the central control system at regular intervals, or send a signal when the any of the level switches are activated.

A second pressure relief valve PRV2 is connected to a pressure relief port provided in a top portion of the pressure vessel 66. Both the first and second pressure relief valves PRV1 and PRV2 are operable to open to allow fluid to flow out to the atmosphere at a safe point, if they are exposed to fluid pressure which is higher than a predetermined level.

PRV1 prevents over pressuring of the riser, diverter system and/or wellbore when the pressure control of the drilling system is governed by PCV1. The relieved flow is directed to a first overboard line 90. PRV2 prevents over pressuring of the riser and diverter system, wellbore, and the pressure vessel 66 when the pressure control of the inventive system is governed by PCV2. The relieved flow is directed to a second overboard line. The relief settings for PRV1 and PRV2 are inputs within the control system (not shown) and are dictated by the lowest pressure rated component within the closed loop system.

Once the diverter assembly is closed and the non-rotating seal is produced, a closed loop system is generated that is subject to the heave cycle of the ocean. The primary function of the damper system 64 is to provide pressure control for the drilling system, and to deliver the capability to compensate the pressure fluctuations within the closed system from the heave of the ocean.

It is appreciated that with all aspects of the inventive system and method implemented in place specific equipment requires modifying to attain the full benefits of the system. Ultimately, the main goal of the inventive system is to provide a diverter system that allows drill string rotation with pressures of up to 1,000 psi—a vast improvement over conventional offshore diverters which are rated to only 500 psi.

PCV2 is the primary pressure control valve for the inventive system once pressure vessel 426 of the damper system has been pressurized by the supplied compressed gas N1 and pressure regulator R1 through valve V6, thus any components contained between the riser (including the riser componentry) and PCV2 require modification to operate at pressures of up to 1,000 psi.

The seal sleeve 36 of the diverter assembly results in a maximum dynamic pressure rating of 1,500 psi. However, a practical maximum operating pressure limit for the diverter assembly is 1,000 psi. With regard to the American National Standard Institute (ANSI), it is important to note that the ANSI 400# pressure class has a maximum pressure rating of 970 to 1000 psi depending on flow temperature conditions. Given the limited pressure rating of the ANSI 400# pressure class, the next class, ANSI 600#, is considered in order to design a safety factor into the system.

For the maximum pressure rating of 1,000 psi to be achieved, key equipment changes are required.

The diverter flow line valves V1, V2, V3, and V4 are typically a 300# pressure class, rated at 720 to 750 psi depending on the flow temperature conditions. These are modified to a 600# class, rating the valves for 1,450 to 1,500 psi depending on the flow temperature conditions.

The pressure vessel 66 of the damper system 64 and its components including LCV1 and PCV2 are designed and fabricated to a 600# class, with a pressure rating of 1,450 to 1,500 psi depending on the flow temperature conditions.

The diverter support housing 18 and its flanged connections for connecting diverter valves V1, V2, V3, and V4 are modified to a 600# class, with a pressure rating of 1,450 to 1,500 psi depending on the flow temperature conditions.

The diverter assembly locking mechanism design must be assessed to confirm capability to restrain the assembly 47 with 1,000 psi of riser pressure below it without mechanically failing.

The lubricating system valve V5 must be a 600# class valve, and pump P1 must be designed to operate with 1,000 psi of riser pressure.

The diverter assembly's upper and lower pressure energized flow line seals 34*a*, 34*b* must be designed to seal at a maximum pressure of 1,000 psi.

The existing upper flex joint 44 connected to the bottom of the support housing 18 must be modified such that its seal maintains its integrity at 1,000 psi.

The existing slip joint is replaced with a high pressure slip joint design, described in the prior art, such that pressure integrity between the inner 46 and outer barrel 8 is maintained through the arrangement of the annular packer seals 415 at 1,000 psi during its extension and retraction over the heave cycle of the ocean. The slip joint is coupled with a displacement meter (not shown) to measure the change in volume resulting from the extension and retraction of the inner barrel. This data is relayed to the control system (not shown) to account for the volume changes through the flow meter F1 throughout the heave cycle. The returned drilling flow rate through flow meter F1 is corrected with these volume changes, as described in the prior art.

It is appreciated that ultimately, this diverter system could potentially have a pressure rating up to 3,000 psi with the appropriate equipment modifications, described herein, completed to a higher class rating. The diverter assembly is statically rated to 3,000 psi, but the omission of the seal sleeve 36 is required to achieve the higher rating.

The drilling system may be used as follows.

A drill string 86 is run into the riser and wellbore, and drilling has commenced. During drilling or circulation, drilling fluid is drawn from the rig's drilling fluid reservoir 60 and injected with a high pressure drilling pump P2 into the drill string 86. The drilling fluid returns up the riser annulus 88, and when utilizing conventionally hydrostatically balanced drilling techniques, the fluid flows through the main diverter flow line 52 via valve V4, and back to the rig's shaker and de-sanding/centrifuging/degassing 58 systems, and returning to the active fluid volume 60. Typically, this is atmospheric gravity flow from the outlet of the main diverter flow line 52 to the shaker inlet, with valves V2 and V3 closed and V4 opened to allow circulation with the conventional system. The starboard diversion line is isolated by closing valve V1, preventing flow in this direction. This method of operation is well known in the art.

The diverter assembly is operated to close and seals on the drill string 86 whenever a riser gas handling event occurs or there is a requirement for pressurized drilling techniques such as MPD.

Once the diverter assembly is closed, the drilling fluid return flow returning up the riser annulus 88 is diverted through the MGS diverter line 54 by opening the MGS diverter valve V3 and closing the main diverter valve V4.

For this example, it is assumed the diverter assembly is closed because a riser gas event has occurred. When activated, the following automated sequence occurs:

- The drill string injection with pump P2 ceases.
- The shut in procedure of the subsea BOP is initiated (not shown).
- The QCA diverter assembly 47 closes and seals around the drill string 86.
- The injected lubricating fluid from pump P1 ceases and valve V5 is closed.
- The closing pressure to the high pressure slip joint packers 50 is increased.
- The MGS diversion line 54 opens via valve V3 and the main diverter flow line 52 to the shakers 58 closes via valve V4.
- Flow is diverted to the pressure vessel 66 flow inlet 68 via the mass flow meter F1 and the first pressure control valve PCV1. Immediate pressure is applied to the riser, increasing its pressure to a value predetermined using standard well control procedures. For example, tests have shown that a pressure of 500 psi is generally sufficient to maintain the gas detected into liquid form.—This is achieved by closing PCV1 to prevent or restrict flow of fluid along the MGS diverter line 54 into the pressure vessel 66. Typically, initially, PCV1 would be completely closed to block the line 54 in order to build the required applied surface pressure for the procedure (500 psi) then it will regulate the pressure to maintain it constant by partially opening and closing.

If the riser pressure required is relatively low, compression of the existing gas volume within the pressure vessel 66 in the upper volume of the vessel 66 and may be sufficient to attain the required system pressure as the fluid level L0 is increased against a closed PCV2. However, this may occupy a timeframe which is not feasible during a riser gas handling event, and therefore the nitrogen precharge process described below is preferably also implemented.

Simultaneously, the bank of nitrogen bottles N1 containing a sufficient total volume of pre-charged nitrogen automatically supplies a regulated R1 inert gas pressure to the vessel 66. This nitrogen precharge increases the pressure in the vessel 66 to the pressure upstream of PCV1. During this precharge phase the vessel 66 pressure is regulated through a pressure regulator R1 on the bottle bank N1, the pressure sensor PT, and PCV2.

The level sensor monitors the operating liquid level L0 of the vessel 66 and keeps it constant through the adjustment of level control valve LCV1 through which liquid is released from the pressure vessel 66 to the MGS 62 via the liquid drain port 76.

As the riser pressure increases the pressure energized flow line seals 34*a*, 34*b* provide the seal between diverter support housing 18 and the diverter assembly, preventing external leakage.

Once the pressure in the pressure vessel 66 equals the riser pressure upstream of PCV1, total flow, PCV1 is opened to its maximum extent, and pressure control of the system moves from PCV1 to the PCV2 and the liquid level control valve LCV1.

The pressure control valve PCV2 and the liquid level control valve LCV1 are operated to maintain pressure within the system given the set points/parameters input into the control system (not shown). The parallel operation of these valves compensate for pressure fluctuations within the closed loop throughout the heave cycle of the ocean.

As the pressure vessel 66 is pressurized, and does not operate at atmospheric pressure like a conventional MGS, it operates as a cyclonic separator, resulting in pressurized flow throughout the system up to PCV2 and LCV1. A pressure drop occurs across these valves and flow conditions downstream are at atmospheric conditions. From here, flow is directed to the inlets 74, 80 of the MGS 62.

The details of the separation process in a standard MGS are well known to persons of skill in the art. A dry gas stream from the MGS is dispersed to atmosphere through a vent line outlet located near the top of the rig's mast structure (not shown), whilst the liquid is directed to the reservoir 60 via the shaker/degasser/centrifuge system 58.

Whenever gas is present in the flow stream 417 returning from the riser annulus during a riser gas handling event or MPD, the majority of the gas breakout and separation occurs in the atmospheric conditions of the UMGS 435. Depending on the operating pressure of the vessel 426, the gas dissolved in the drilling fluid may still be above its bubble point pressure within the vessel 426. Thus, gas breakout within the vessel 426 does not occur, and it is only until the flow stream discharges through the liquid level control valve LCV1 or PCV2 at near atmospheric conditions that the gas begins to break out of solution. Once the flow stream enters the UMGS 435 at atmospheric conditions gas is below its bubble pressure and breaks out of solution, allowing it to be separated within the UMGS 435. During operating conditions where PCV1 is used to control the pressure of the system, gas breakout may ensue within the vessel 426. However, the separation efficacy decreases as the vessel 426 is precharged to the required pressure $P_{N2}$ and the gas begins to re-dissolve into solution.

It should be appreciated that when the diverter assembly is closed and before the subsea BOP is closed both reciprocation and rotation of the drill string 86 is permitted through the seal sleeve 36. This may be required given the pre-existing drilling conditions before the riser gas event occurred to prevent the sticking of the drill string 86.

As mentioned above, the first pressure control valve, PCV1, is installed downstream of the flow meter F1 on the MGS diversion line. Its primary function is to allow immediate application of surface pressure to the riser during a riser gas event, as described in the prior art, or initially during MPD. PCV1 controls the flow and pressure of the riser while the vessel 66 pre-charges to the required riser pressure.

Whilst possible under some circumstances, the ability to achieve the desired pressure within the vessel 66 by closing PCV2 and using only the compression of the atmospheric gas volume above its liquid level within an immediate time frame is problematic. At higher magnitudes of pressure, the liquid level within the vessel 66 may reach a hazardous high level HHL close to the inlet 68 before the gas is compressed sufficiently to reach the desired pressure.

For example, control of a riser gas event may require an instant pressure application of 400 psi. This cannot be achieved within an immediate timeframe using the vessel 66, PCV2, and the gas volume within the vessel 66. Thus, a precharge gas is required. Therefore, PCV1 is adjusted to apply 400 psi of pressure instantly until the vessel 66 is pressurized to 400 psi using the nitrogen bank N1. After sufficient inert gas volume at a specific precharge pressure is supplied by the bottle bank N1 to precharge the vessel 66 to the required pressure (400 psi), as detected by pressure transmitter P1, a signal is transmitted to the central control (not shown) and the flow of nitrogen from N1 ceases from the bottle bank N1, and valve V6 is closed to isolate the bank N1. PCV1 is then opened again, and pressure control moves from PCV1 to PCV2 with the system pressure remaining constant throughout the process.

As such, the nitrogen bottle bank N1 and regulated R1 nitrogen supply ensures the pressure compensation can be achieved in the pressure vessel 66 before the transfer of the pressure control from PCV1 to PCV2 and LCV1 takes place.

The nitrogen pressure regulator R1 provides a pressure step down from the stored precharge pressure of the bottle bank N1. For example, the bottle bank may be stored with a precharge of 3,000 psi to supply sufficient gas volume at lower pressures—the regulator R1 regulates the pressure from 3,000 psi to 1,000, the maximum operating pressure of the vessel 66.

If, at any stage during MPD or gas handling operations the incoming gas or liquid rates into the vessel 66 are approaching its design capacity all flow is diverted overboard, with a dangerously high fluid level HHL detected by the level sensor and associated alarm. This is achieved through remotely opening the starboard diverter valve V1, routing all flow to the starboard diverter line and overboard. Alternatively, the port side overboard diverter line may be opened by remotely opening the portside overboard valve V2, routing all flow overboard via the port vent line 56. During this process, the vessel 66 is isolated by closing the MGS diversion line valve V3.

The two pressure relief valves PRV1 and PRV2 provide added overpressure protection. PRV1 prevents over pressuring of the riser, diverter system and/or wellbore when the pressure control of the inventive system is governed by PCV1. The relieved flow is directed to either the port or starboard overboard line. PRV2 prevents over pressuring of the riser and diverter system, wellbore, and the vessel 426 when the pressure control of the inventive system is governed by PCV2. The relieved flow is directed to either the port or starboard overboard line. The relief settings for PCV1 and PCV2 are inputs within the control system (not shown) and are dictated by the lowest pressure rated component within the closed loop system.

To convert from conventional drilling to MPD, the following sequence occurs:

- The diverter assembly closes and seals around the drill string 86, and the closing pressure is adjusted for the expected applied surface pressure
- The closing pressure to the high pressure slip joint packers 50 is increased.
- The MGS diverter line 54 opens via valve V3 and the conventional flow path 52 to the shakers 58 is closed using valve V4.
- Drill pipe injection commences at the required drilling rate.
- Flow is diverted to the pressure vessel 66 flow inlet 68 via the mass flow meter F1 and the first pressure control valve PCV1. Immediate pressure is applied to the riser, increasing its pressure to a predetermined value based on the expected fracture and pore pressure, by closing PCV1 to prevent or restrict flow of fluid along the MGS diverter line 54 into the pressure vessel 66. Again, typically, initially, PCV1 would be completely closed to block the line 54 in order to build the required applied surface pressure for the procedure (500 psi) then it will regulate the pressure to maintain it constant by partially opening and closing.
- If the riser pressure required is relatively low, compression of the existing gas volume within the pressure vessel 66 in the upper volume of the vessel 66 and may be sufficient to attain the required system pressure as the fluid level L0 is increased against a closed PCV2. However, this may occupy a timeframe which is not feasible during a riser gas handling event, and therefore the nitrogen precharge process described below is preferably also implemented.
- Simultaneously, the bank of nitrogen bottles N1 containing a sufficient total volume of pre-charged nitrogen automatically supplies a regulated R1 inert gas pressure to the vessel 66. This nitrogen precharge increases the pressure in the vessel 66 to the pressure upstream of PCV1. During this precharge phase the vessel 66 pressure is regulated through a pressure regulator R1 on the bottle bank N1, the pressure sensor PT, and PCV2.
- The level sensor monitors the operating liquid level L0 of the vessel 66 and keeps it constant through the adjustment of level control valve LCV1 through which liquid is released from the pressure vessel 66 to the MGS 62 via the liquid drain port 76.
- Valve V5 is opened and the injection of lubricating fluid from pump P1 commences.
- As the system pressure increases the pressure energized flow line seals 34*a* and 34*b* provide the seal between diverter support housing 18 and the diverter housing 12, preventing external leakage.
- Once the pressure in the pressure vessel 66 equals the riser pressure, total flow and pressure control of the system moves from the secondary PCV1 to the primary PCV2 and the liquid level control valve LCV1.
- The pressure control valve PCV2 and the liquid level control valve LCV1 maintain pressure within the system given the set points/parameters input into the control system (not shown). The parallel operation of these valves compensate for pressure fluctuations within the closed loop throughout the heave cycle of the ocean.
- The pressure vessel 66 ultimately operates as a cyclonic separator versus a conventional atmospheric vessel. Flow is directed from the vessel 426 to the inlets 436, 437 of the UMGS 435 through PCV2 and LCV1.
- Pipe rotation commences through the seal sleeve 36 of the diverter assembly and drilling begins.
- Generally most of the gas breakout and separation occurs in the MGS 62 during MPD, with minimal gas breakout occurring within the pressure vessel 66 but this is dependent on the bubble point pressure and vessel 66 pressure $P_{N2}$.

Whenever gas is present in the flow stream returning from the riser annulus 88 during a riser gas handling event or MPD, the majority of the gas breakout and separation occurs in the atmospheric conditions of the MGS 62. Depending on the operating pressure of the vessel 66, the gas dissolved in the drilling fluid may still be above its bubble point pressure within the vessel 66. Thus, gas breakout within the vessel 66 does not occur, and it is only until the flow stream discharges though the liquid level control valve LCV1 or PCV2 at near atmospheric conditions that the gas begins to break out of solution. Once the flow stream enters the MGS 62 at atmospheric conditions gas is below its bubble pressure and breaks out of solution, allowing it to be separated within the MGS 62. During operating conditions where PCV1 is used to control the pressure of the system, gas breakout may ensue within the vessel 66. However, the separation efficacy decreases as the vessel 66 is precharged to the required pressure $P_{N2}$ and the gas begins to re-dissolve into solution.

Whether the diverter assembly is closed for MPD or for riser gas handling, as mentioned above, whenever the diverter assembly is closed and the wellbore is exposed to surface pressure fluctuations from ocean heave, pressure compensation must be provided. Whilst this may be provided for using a damper system as described in WO2011/104279, in this embodiment of the invention, the vessel's heave and the resultant pressure fluctuations within the closed loop system are compensated through the operation of PCV2 and LCV1 on the pressure vessel 66 once it is pressurized.

As mentioned above, LCV1 is located downstream of the liquid drain port 76, and the pressure vessel 66 is coupled with pressure sensor P1 which transmits the vessel pressure data $P_{N2}$ to PCV2 via the central control system (not shown). The pressure vessel 66 is also coupled with a level indicator sensor and level switch with set points for high fluid level LH, operating fluid level L0, and low fluid level LL. The liquid level data is also transmitted to the central control system and relayed to the level control valve LCV1 for its adjustment to maintain the operating fluid level L0 relatively constant.

As the high pressure slip joint inner barrel 46 extends and retracts with the heave of the ocean, the closed loop described herein will compress and decompress the fluid and gas volume. Once the subsea BOP is closed during riser gas handling this is not as much of a concern as the wellbore is isolated. However, during MPD or other pressurized drilling techniques, the wellbore is exposed to these changes in pressure and so the pressure variation must be addressed due to the instability it creates in the BHP.

In one embodiment of the invention, PCV2 and LCV1 pressure compensate the heave through the following method.

For this example, it is assumed 400 psi of surface pressure is currently being applied and maintained on the entire system via PCV2.

With steady state flow into the vessel inlet 68 a constant operating fluid level L0 is present in the vessel 66, detected and monitored through level indicator LI0 of the level indicator sensor. It is desired to maintain a reasonably constant operating fluid level L0 in the vessel 66 during circulating and drilling. LCV1 is set at a predetermined position to regulate L0, maintaining the level constant in the vessel 66 at the given drilling rate injected into the drill string 86. LCV1 is adjusted through the central control system (not shown) to regulate the return fluid flow from the liquid drain port 76 to the MGS liquid inlet 80 by varying the extent to which it restricts flow of liquid along the liquid flow line 78. PCV2 is set to maintain a specified applied surface pressure for drilling at these conditions, and $P_{N2}$ is adjusted using PCV2 and the continuous transmission of data from pressure transmitter P1 to the central control system.

As the rig heaves upwards, the inner barrel 46 extends, the closed loop volume increases, and the liquid level in the pressure vessel 66 tends to decrease from the operating level L0 to a lower level LL as the flow rate at the pressure vessel inlet port 68 is transiently decreased. As more "total volume" is now present, the total system pressure tends to decrease with a corresponding decrease in the fluid level to LL. This is detected by the level indication LIL of the level sensor and the change in $P_{N2}$ detected by the pressure transmitter P1 during the event. The level control valve LCV1 adjusts to a more closed position, in which the degree of restriction of fluid flow along the liquid flow line 78 is increased, increasing the fluid level from LL to L0, while PCV2 adjusts to a more closed position maintaining $P_{N2}$ at constant at the required applied surface pressure during the heave cycles.

When the inner barrel 46 retracts, the closed loop volume decreases, and the liquid level in the vessel 66 increases from the operating fluid level L0 to a higher fluid level LH with a transient increase in the flow rate at the vessel inlet port 68. As less "total volume" is now present, the total system pressure tends to increase with a corresponding increase in the fluid level to LH. This is detected by the level indication LIH of the level sensor and the change in $P_{N2}$ is detected by the pressure transmitter P1 value during the event. The level control valve LCV1 adjusts to a more open position, decreasing the fluid level from LH to L0, while PCV2 adjusts to a more open position maintaining $P_{N2}$ at the applied surface pressure constant over this cycle of the heave.

Alternatively, if no heave, or only relatively minor, heave is present such that a negligible change in the slip joint displacement is occurring, the pressure compensation can be achieved using minor adjustments to the position of PCV1 with PCV2 closed.

Thus, it is appreciated there is a continuous adjustment of PCV2 and LCV1 due to a continuously changing fluid level within the pressure vessel 46 over the heave cycle in order to achieve pressure compensation within the inventive system. Hence, in this embodiment of the invention, there is no requirement for an additional pressure damper system, as disclosed in the prior art.

It is appreciated that all aspects of the drilling system and method described above are advantageously governed by a central control system (not shown), which may include a series of Programmable Logic Controllers PLC, central processing units CPU, and electronic control units ECU, all well known in the art.

The inventive system and method differs from the conventional operation of a drilling MGS, where it is operated as an atmospheric vessel. The pressure vessel 66 of the inventive system functions as a pressurized vessel, resulting in pressurized flow and not relying on gravity flow for its operation. This differs from a conventional MGS, which requires atmospheric pressure and gravity flow to function effectively.

For example, in a prior art system without the pressure vessel 66, the MGS 62 is an atmospheric vessel and its liquid inlet port 80 would be situated at a vertical distance

H1−H2 below the main diverter flow line 52 during drilling such that gravity flow into the MGS 62 is achieved. H1 is the elevation of the main diverter flow line outlet 28*b* and H2 is the elevation of the liquid inlet 80 of the MGS 62 from reference datum H. The vertical distance can be of any value between the diverter flow line outlet 28*b* and the MGS liquid inlet, as long as a declined flow path results.

The liquid outlet of the liquid seal of the MGS 62 would be situated at a vertical distance

H3−H4 above the shaker etc 58 where H3 is the elevation of the liquid outlet of the liquid seal and H4 is the elevation of the inlet to the rig shaker etc 58 from reference datum H. This allows gravity driven flow from the liquid outlet of the MGS 62 to the shaker etc 58. The vertical distance can be of any value between the MGS liquid outlet and the shaker etc 58, as long as a declined flow path results. Thus, the positioning deck elevation is crucial for the atmospheric operation of the MGS 62, restricting the options for its placement on the offshore installation.

When the drilling system is operated as described above, i.e. with the vessel 66 pressurised, the pressure vessel 66 can be positioned at any given elevation (within reason) relative to the MGS liquid inlet port 80 and diverter outlet port 28*b* on the offshore installation. As it does not rely on gravity flow for its operation, the vessel inlet 68 could be positioned above the diverter outlet port 28*b* elevation H1, and its outlet ports 70, 76 positioned below the MGS inlets 74, 80 elevation H2. To ability to position the pressure vessel 66 at any deck elevation on the rig within reason may be advantageous with respect to integrating the inventive system into older offshore rigs where space and/or equipment positioning options may be limited.

Figure 4:
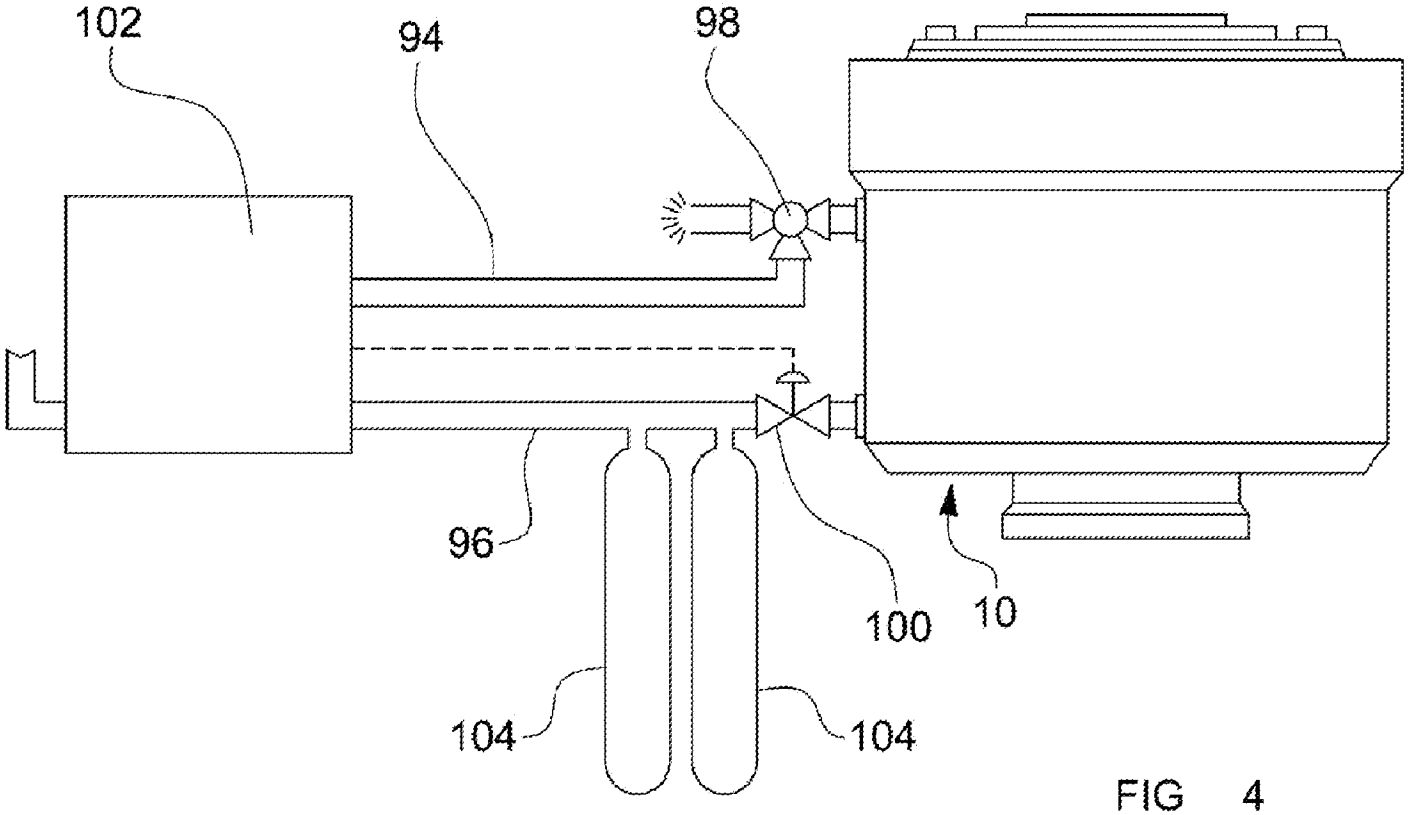
FIG. 4 is a schematic illustration of one embodiment of control system for opening and closing a diverter according to the invention.

Referring finally to FIG. 4, this illustrates one embodiment of control system suitable for operating the diverter assembly. In FIG. 4, there is shown an open line 94 which is connected to the open chamber of the diverter assembly (not shown) via a fluid flow passage (not shown) through the diverter housing 12. There is also shown a close line 96 which is connected to the close chamber (not shown) via another fluid flow passage in the diverter housing 12. Preferably the close line 96 is a relatively large bore conduit (2 inches and above). The open line 94 may also be similarly sized.

The fluid flow passages in the diverter housing 12 are typically 1 inch in diameter, so to give the connection between the open chamber or the close chamber and the lines 94, 96 at the exterior of the housing 12 the equivalent flow area to a 2 inch diameter, four fluid flow passages may be manifolded together for each of the open and close lines 94, 96. Alternatively, each of the fluid flow passages may be connected to a separate open or close line of smaller than 2 inches in diameter (1 inch diameter, for example), the total flow area provided by all the open or close lines being greater than or equal to the flow area provided by a single 2 inch diameter pipe.

A quick dump shuttle valve 98 is provided in the open line 94 directly adjacent the diverter housing. This valve 98 has a vent to atmosphere, and is a three-way shuttle valve which is movable between a first position in which fluid flow along the open line 94 is permitted, and a second position in which the open chamber is connected to the vent to atmosphere.

Typically, the quick dump shuttle valve 98 is biased (advantageously by means of a spring) into the second position, and moves against the biasing force into the first position when there is sufficient pressure in the open line 94.

An electrically or electronically operable close control valve 100 is provided in the close line 96 directly adjacent the diverter housing 12. This valve 100 is movable (for example by means of a solenoid or piezoelectric element) between a closed position in which flow of fluid along the close line 96 is substantially prevented, and an open position, in which flow of fluid along the close line 96 is permitted. Preferably, biasing means is provided to bias the close valve 100 to the closed position, and supply of electrical current to the close valve 100 causes the close valve 100 to move to the open position.

Control of the supply of electrical current to the close valve 100 is carried out by an electronic control unit in a hydraulic diverter control system 102 which is located remotely from the diverter 10, typically in a diverter control room.

The control system 102 also comprises a pump which is operable to draw fluid from a fluid reservoir and which is connected, via a valve or plurality of valves, to the open line 94 and the close line 96. In preferred embodiment of the invention, the fluid is a non-corrosive, non-foaming environmentally-friendly fluid such as water containing a small amount of corrosion inhibitor. A non-return valve is provided in each of the open line 94 and close line 96 to prevent back flow of fluid towards the pump.

The valves of the control system 102 are electrically or electronically operable to direct fluid from the pump to either the open line 94 or the close line 96. Preferably, operation of this valve or valves is controlled by the electronic control unit which controls operation of the close valve 100.

Two accumulators 104 are provided in the close line 96, close to or directly adjacent the close valve 100. Preferably, the accumulators are no more than 15 ft from the close chamber.

These accumulators 104 are of conventional construction, and in this embodiment comprise a bottle, the interior of which is divided into two chambers by a diaphragm. The chamber at the closed end of the bottle is filled with an inert gas, and the other chamber is connected to the close line 96. Thus, operating the control system 102 to pump fluid along the close line 96 whilst the close valve 100 is in the closed position will cause pressurised fluid to be stored in the accumulators 104.

It should be appreciated, of course, that one or more than two accumulators 104 may equally be provided.

During normal use, the quick dump shuttle valve 98 is in its second position, i.e. with the open chamber venting to atmosphere, the accumulators 104 are pressurised to a predetermined pressure, the close valve 100 is in its closed position, the pump is inactive, and the valves in the control system 102 are arranged such that the pump output is connected to the close line 96. If a kick is detected in the well bore, and it is necessary to close the diverter 10, the electronic control unit of the control system 102 is programmed to operate the close valve 100 to move it to its open position, and to activate the pump to pump fluid along the close line 96. Pressurised fluid is thus supplied to the close chamber of the diverter 10, which then moves to its closed position, whilst the fluid expelled from the open chamber is vented to atmosphere at the quick dump shuttle valve 98.

By positioning the accumulators 104 close to the diverter 10, and using a relatively large diameter close line 96, there is minimal time delay after the opening of the close valve 100 before the pressurised fluid starts to reach the close chamber. Moreover, using a relatively large diameter open line 94, and venting the open chamber to atmosphere at the quick dump shuttle valve 98 minimises the resistance exerted by the fluid in the open chamber opposing this movement of the piston 16.

These factors combined means that particularly rapid closing of the diverter 10 can be achieved. In fact, for a diverter 10 with an outer diameter of 46.5 inches and a 21¼inch inner diameter mounted around a 5 inch drill pipe, complete closing of the diverter 10 can be achieved in 3 seconds or less. Without a drill pipe present, the closing time may be increased to 5 seconds or less. The closing time can be reduced by increasing the number of accumulators 104 in the close line 96. Thus, by virtue of using this control system, the closing speed on the riser annulus may be greatly enhanced when compared to conventional diverters. This may provide a heightened response time to seal the riser when riser gas is present, and, ultimately, may enhance safety on the rig.

To open the diverter 10, the electronic control unit of the control system 102 is programmed to operate the valves in the control system 6 to connect the pump output to the open line, and to activate the pump. Pressurised fluid is thus supplied to the open chamber, and the piston moves back to return the diverter 10 to its open position. The fluid from the close chamber is returned to the reservoir via the control system 102.

In an alternative embodiment of the invention, rather than venting to atmosphere, the vent of the quick dump shuttle valve 98 may be connected to a fluid reservoir (which may be the reservoir from which the pump draws fluid) via a pipe which has a significantly larger diameter than the open line 94 and the close line 96. By using a relatively large diameter pipe, flow of fluid out of the open chamber is relatively unimpeded, and, again, there is little resistance to movement of the piston 16 to the closed position.

It is appreciated with this aspect of the inventive system that a more simplistic installation and cost effective solution results when compared to conventional RGH systems, as described in the prior art. A higher pressure rated diverter system may not result with this aspect of the inventive system without modification of additional equipment. However, with this aspect of the inventive system and method the response time is greatly enhanced for sealing off the riser.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A drilling system including:

a riser, a pressure vessel;

a source of pressurised gas;

a main flow line which extends from the riser to the pressure vessel, the pressure vessel having a liquid inlet port connected to the main flow line;

a gas inlet port connected to the source of pressurised gas;

a liquid outlet port located in a lowermost portion of the pressure vessel;

a gas outlet port located in an uppermost portion of the pressure vessel;

a liquid pressure control valve which is operable to control the flow of liquid out of the pressure vessel via the liquid outlet port;

a mud gas separator which has a liquid inlet port to which the liquid outlet port of the pressure vessel is connected by means of a liquid flow line, the liquid pressure control valve being provided in the liquid flow line; and a gas pressure control valve which is operable to control the flow of gas out of the pressure vessel via the gas outlet port, wherein, the mud gas separator has a gas inlet port to which the gas outlet port of the pressure vessel is connected by means of a vent line, and the gas pressure control valve is provided in the vent line.

2. The drilling system according to claim 1, wherein a valve is provided in a line connecting the source of pressurised gas to the gas inlet port of the pressure vessel.

3. The drilling system according to claim 1, wherein a secondary pressure control valve is provided in the main flow line, and the main flow line is connected to the riser via a diverter.

4. The drilling system according to claim 3, wherein the diverter includes a diverter assembly which is operable to close around a drill string extending down the riser to contain pressure in the annulus of the riser around the drill string.

5. The drilling system according to claim 4, wherein the diverter assembly is operable to close around the drill string extending down the riser to contain pressure in the annulus of the riser around the drill string whilst allowing the drill string to rotate about its longitudinal axis.

6. The drilling system according to claim 4, wherein the diverter assembly is mounted in a diverter support housing which is adapted, in use, to be suspended from a rig floor.

7. The drilling system according to claim 1, further comprising a drill string extending down the riser.

8. A method of operating a drilling system including a riser, a pressure vessel, a source of pressurised gas, and a main flow line which extends from the riser to the pressure vessel, the pressure vessel having a liquid inlet port connected to the main flow line, a gas inlet port connected to the source of pressurised gas, a liquid outlet port located in a lowermost portion of the pressure vessel, a liquid pressure control valve which is operable to control the flow of liquid out of the vessel via the liquid outlet port, a gas outlet port located in an uppermost portion of the pressure vessel, a gas pressure control valve which is operable to control the flow of gas out of the vessel via the gas outlet port, and a mud gas separator which has a liquid inlet port to which the liquid outlet port of the pressure vessel is connected by means of a liquid flow line, wherein the mud gas separator has a gas inlet port to which the gas outlet port of the pressure vessel is connected by means of a vent line, and the gas pressure control valve is provided in the vent line, wherein the method includes the steps of operating one or both of the liquid pressure control valve and gas pressure control valve to control the pressure in the riser.

9. The method according to claim 8, further including the steps of opening both the gas pressure control valve and liquid pressure control valve so as to decrease the degree to which the valves restrict flow of fluid out of the pressure vessel in order to decrease the pressure in the riser, or closing both the gas pressure control valve and liquid pressure control valve so as to increase the degree to which the valves restrict flow of fluid out of the pressure vessel in order to increase the pressure in the riser.

10. The method according to claim 8, wherein the liquid pressure control valve is provided in the liquid flow line.

11. The method according to claim 8, wherein a secondary pressure control valve is provided in the main flow line, and the method includes the steps of operating the secondary pressure control valve to control the gas pressure in the riser and operating the liquid pressure control valve and/or the gas pressure control valve to bring the pressure in the pressure vessel to a desired level, and then opening the secondary pressure control valve to decrease the extent to which it restricts the flow of fluid along the main flow line, before operating the liquid pressure control valve and/or gas pressure control valve to control the pressure in the riser.

12. The method according to claim 11, wherein the system includes a gas supply valve which controls the flow of gas from the source of pressurised gas into the pressure vessel, and method includes the step of opening the gas supply valve after closing the gas pressure control valve and the secondary pressure control valve.

13. The method according to claim 8, wherein the main flow line is connected to the riser via a diverter, and the diverter includes a diverter assembly, and the method includes operating the diverter assembly to close around a drill string extending down the riser to contain pressure in the annulus of the riser around the drill string.

14. The method according to claim 13, wherein the diverter assembly is closed prior to operating the gas pressure control valve and liquid pressure control valve.

15. The method according to claim 8, wherein the system further includes a pressure sensor which is operable to provide an output indicative of the pressure of the gas in the uppermost region of the pressure vessel, and the method includes using the output of the pressure sensor to determine how to operate the gas pressure control valve and/or the liquid pressure control valve.

16. The method according to claim 15, wherein the system further includes a liquid level sensor which is operable to provide an output indicative of the level of the liquid in the pressure vessel, and the method includes using the output of the pressure sensor to determine how to operate the liquid control valve.

17. The method according to claim 8, wherein the drilling system includes a drill string extending down the riser.

* * * * *